US005435848A

United States Patent [19]

Tanokuchi et al.

[11] Patent Number: 5,435,848

[45] Date of Patent: Jul. 25, 1995

[54] APPARATUS FOR CONTROLLING THICKNESS OF COATED FILM ON WEB-LIKE MEMBER BY ROLL COATER

[75] Inventors: Ichiro Tanokuchi, Kurashiki; Takao Ikenaga, Okayama, both of Japan

[73] Assignee: Kawasaki Steel Corporation, Hyogo, Japan

[21] Appl. No.: 151,114

[22] Filed: Dec. 17, 1993

Related U.S. Application Data

[62] Division of Ser. No. 963,894, Oct. 20, 1992, Pat. No. 5,310,573.

[30] Foreign Application Priority Data

Oct. 23, 1991 [JP] Japan ..... 3-303972
Dec. 16, 1991 [JP] Japan ..... 3-352796

[51] Int. Cl.[6] ..... B05C 1/08

[52] U.S. Cl. ..... 118/688; 118/689; 118/690; 118/708

[58] Field of Search ..... 118/688, 689, 690, 708; 427/9, 428; 430/30

[56] References Cited

U.S. PATENT DOCUMENTS

| | | | |
|---|---|---|---|
| 4,277,549 | 7/1981 | Tatsumi et al. | 430/30 |
| 4,930,440 | 6/1990 | Shirono | 118/708 |
| 4,955,317 | 9/1990 | Kinoshita et al. | 118/689 |
| 5,116,711 | 5/1992 | Kobayashi et al. | 430/106 |

FOREIGN PATENT DOCUMENTS

| | | |
|---|---|---|
| 58-6268 | 1/1983 | Japan . |
| 58-166959 | 10/1983 | Japan . |
| 60-56553 | 4/1985 | Japan . |
| 60-64664 | 4/1985 | Japan . |
| 62-41077 | 2/1987 | Japan . |
| 2-305750 | 12/1990 | Japan . |
| 3-270759 | 12/1991 | Japan . |

OTHER PUBLICATIONS

R. W. Khoury and D. C. Tao, "Toner Concentration Sensor," IBM Technical Disclosure Bulletin, vol. 13, No. 12 (May 1971), p. 3607.

Patent Abstracts of Japan, vol. 016, No. 081, 27 Feb. 1992 & JP-A-32 70 759 (Kawasaki Steel Corp.), 2 Dec. 1991.

Patent Abstracts of Japan, vol. 013, No. 042, 30 Jan. 1990 & JP-A-63 242 375 (Sumitomo Metal Ind. Ltd.), 7 Oct. 1988.

Patent Abstracts of Japan, vol. 012, No. 231, 30 Jun. 1988 & JP-A-63 024 119 (Kawasaki Steel Corp.), 1 Feb. 1988.

Patent Abstracts of Japan, vol. 014, No. 340, 23 Jul. 1990 & JP-A-21 16 705 (Kawasaki Steel Corp.), 1 May 1990.

Patent Abstracts of Japan, vol. 005, No. 054, 15 Apr. 1981 & JP-A-56 007 663 (Murayama Fumio), 26 Jan. 1981.

*Primary Examiner*—W. Gary Jones
*Assistant Examiner*—Laura E. Edwards
*Attorney, Agent, or Firm*—Oliff & Berridge

[57] ABSTRACT

An apparatus for controlling thickness of a coated film of paint on a continuously moving sheet member. A paint in a paint pan is picked up through a gap $h_{PA}$ formed between a pickup roll and an applicator roll, part of the paint is attached to the applicator roll and delivered to a sheet as a supply flow rate $q_A$. The film thickness coated on the sheet is controlled in accordance with a model equation: $M=\{(q_A-q_L)'\gamma'C\}/LS$ which has evaluated a difference between the supply flow rate $q_A$ and a leak flow rate $q_L$ not transferred onto the sheet, remaining on the applicator roll and escaping through a gap $h_{AS}$ ($\Xi$ is the specific gravity of the paint, C the concentration of a solid content of the paint and LS a moving speed of the sheet).

3 Claims, 28 Drawing Sheets

APPARATUS FOR CONTROLLING THICKNESS OF COATED FILM ON WEB-LIKE MEMBER BY ROLL COATER

This is a division of U.S. application No. 07/963,894 filed Oct. 20, 1992, now U.S. Pat. No. 5,310,573.

BACKGROUND OF THE INVENTION

1. Field of the Invention

The present invention relates to a method of controlling thickness of the coated film on the web-like member by the roll coater, and more particularly to a method of controlling thickness of the coated film on the web-like member by the roll coater, wherein, when coating is performed continuously on the web-like member such as cold-rolled steel plate by the roll coater, the film thickness can be controlled at high accuracy.

2. Prior Art

With the steel sheets, in order to improve the performance such as corrosion resistance, for example, there has been commonly practiced coating of chrome, resin and the like is made on a galvanized steel sheet.

The above-described coating onto the steel sheet is performed such that the steel sheet paid off from a payoff reel in an inlet facility, while being continuously conveyed, passes through processes including a degreasing process, a coating process by use of a roll coater and a drying process by use of an oven (same process is repeated as necessary). Then, the steel sheet after the coating is adapted to be wound up by a wound-up device in an outlet facility.

In general, the roll coater used for continuous coating of the steel sheet includes a steel pickup roll for picking up a paint in a paint pan and a rubber-lined applicator roll for receiving the paint from the pickup roll and for transferring and coating the paint onto the surface of the steel sheet. When the coating is performed by use of this roll coater, the control of the thickness of the coated film is performed by suitably controlling the circumferential speeds of rolls, an urging force between the pickup roll and the applicator roll and an urging force between the steel sheet and the applicator roll with respect to a conveying speed of the steel sheet.

Now, in the recent years, the coated steel sheets have been used for the wider application in the domestic electrical equipment, motor vehicles, building materials and the like, whereby the material quality required by the demands such as the improved anticorrosion performance is raised and the accuracy of the thickness of the coated film comes to be very strict.

Heretofore, as the method of controlling the thickness of the coated film in the coating by use of-the roll coater, there has been known a method of controlling the urging force between the pickup roll and the applicator roll and the urging force between the steel sheet and the applicator roll at predetermined values constantly as disclosed in Japanese Patent Laid-Open No. 6268/1983, and Patent Application Publications No. 56553/1985 and No. 41077/1987, for example, and a method of controlling the urging force between the pickup roll and the applicator roll in accordance with data concerning the relationship between the urging force and the thickness of coated film in the coating in the past as disclosed in Japanese Patent Laid Open No. 166959/1983 and Patent Application Publication No. 23225/1991, for example. However, as for the specific details of the methods of controlling and model equations, there is none described at all.

Furthermore, as another method of controlling the thickness of the coated film, such a method has been adopted that there is used a control equation based on only the circumferential speeds of the rolls and the moving speed of the steel sheet, and determined by the experimental regression.

Subsequently, explanation will be given of the case of continuously coating the rear surface of the web-like member, as in the case of both surfaces coating.

In general, in the process of continuously coating the both surfaces of the web-like member such as the steel sheet, as shown in FIG. 43, first, the front surface of a steel sheet S is coated by a first roll coater 10 at the first stage, subsequently, the rear surface is coated by a second roll coater 20, thereafter, the steel sheet is passed through a heating furnace 22 for drying and passed through a cooling furnace 24 for cooling, and delivered to the succeeding process. Incidentally, in the drawing, reference numeral 26 is a lift roll and 28 an outlet side fulcrum roll.

The above-described first roll coater 10 is constituted by a pickup roll 14 for picking up a paint P in a paint pan (paint pool), an applicator roll 16 for delivering part of the paint P picked up by the pickup roll 14 and transferring the paint onto the steel sheet S, and a backup roll 18 for urging the steel sheet S against the applicator roll 16 when the paint is transferred by the applicator roll 16. The above-described second roll coater 20 has the substantially same construction as the first roll coater 10 except for it has no backup roll.

When the both surfaces of the steel sheet S are coated, the steel sheet S is passed between the applicator roll 16 and the backup roll 18 in a state where the steel sheet S is wound around the backup roll 18 of the roll coater 10 to thereby coat the front surface, and subsequently, the rear surface is coated by passing the steel sheet S over the second roll coater 20, with the steel sheet S continuously conveyed in a catenary shape (in a suspended state) being pushed up by the applicator roll 16 of the second roll coater 20 from below.

At this time, the thickness of the film coated on the steel sheet S is greatly influenced by the urging force between the steel sheet S and the applicator roll 16, so that it becomes important to control the urging force to a target value. However, when the front surface is coated by the above-described first roll coater 10, the urging force between the steel sheet S and the applicator roll 16 can be positively controlled by the backup roll 18, whereas, when the rear surface is coated by the second roll coater 20, the urging force between the steel sheet S and the applicator roll 16 is determined by a tension acting on the steel sheet S, so that the urging force cannot be positively controlled.

Therefore, when the rear surface of the steel sheet S is coated by the above-described second roll coater 20, it is conceived that coating is made with the catenary shape being held constant. In order to hold the catenary shape constant as described above, in the steady state where the steel sheets S which are identical with one another are continuously coated, a unit tension (tension/sectional area of the steel sheet) should be controlled to a constant value. However, for example, when a preceding steel sheet and a succeeding steel sheet, which are different in size from each other, jointed together and have a sheet joint point (connecting portion) where the sectional areas of the both steel sheets differ from each other, are coated, at the time of the unsteady state where the sheet joint point passes through the catenary, the tension should be changed every moment to limit the fluctuations in the catenary shape to the minimum.

As a method of changing the tension with time when the sheet joint point passes through the catenary, there is a method disclosed in Japanese Patent Laid-Open No. 305750/1990, for example. This is a method wherein the tension in the catenary is calculated from tracking information of the joint position between the long materials being present in the catenary and being different in size or material quality, and information of the respective sizes and material qualities of the preceding material and the succeeding material which are present in front and back of the joint position, the height of the catenary is successively calculated in accordance with the joint position from the above-described tracking information, information of the sizes and material qualities and the calculated catenary tension, the catenary tension is monitored, and an excessive catenary tension or the fluctuations of the height of the lowest point of the catenary are suppressed in association with a deviation between the catenary height and the height of the catenary before the joint position enters the catenary, or by increasing or decreasing the speed of delivering the long materials when the catenary tension exceeds a predetermined value.

As described above, to hold constant the catenary shape, it is necessary to change the tension in accordance with the passing position of the sheet joint point when the sheet joint point of the steel sheets different in sectional area from each other passes through the catenary section, whereby the urging force between the steel sheet S and the applicator roll 16 is adapted to be changed every moment.

When the above-described urging force to the applicator roll 16 is changed as described above, as the coating conditions are typically shown in FIG. 44, when the urging force $N_A$ comes to be lower than the target value, the leak flow rate $q_L$ of the paint P escaping through without being transferred to the steel sheet S becomes higher, whereby the coating build-up onto the steel sheet S becomes lower than that at the time of the steady state. On the contrary, when the urging force $N_A$ comes to be higher than the target value, the leak flow rate $q_L$ is decreased, whereby the coating build-up onto the steel sheet S becomes higher.

When the coating build-up onto the steel sheet S changes as the urging force $N_A$ changes every moment, the thickness of the coated film should necessarily change; increasing or decreasing, thus resulting in defects of quality.

To explain this specifically, when the sheet joint point is passing through the catenary section, in spite of that the tension acting on the catenary section changes every moment so as to change the tension of the preceding steel sheet (the tension of the preceding steel sheet for holding the catenary shape) into the tension of the succeeding steel sheet (the tension of the succeeding steel sheet for holding the catenary shape), heretofore, upon passing of the sheet joint point over the applicator roll 16, a nip pressure (urging force) Np has been immediately set because the tension of the succeeding steel sheet is regarded as being realized, whereby, there has be such a problem that, when the preceding steel sheet (designated as the preceding material in the drawing) is larger in sectional area than the succeeding steel sheet (designated as the succeeding material in the drawing) as shown in FIG. 45, in spite of that chromate coating having a target film thickness of 50 mg/m$^2$ is performed for example, the coating weight is changed greatly.

Then, heretofore, to prevent the change in the coating weight accompanied by the passing of the sheet joint point over the applicator roll 16, when the steel sheets greatly different in sectional area from each other are continuously coated, to compensate the difference in the ratio of sectional area therebetween, connecting steel sheet having values of sectional areas between the above-described steel sheets have been successively connected so as to be included within predetermined ratio of the sectional areas, so that the ratio of the sectional areas at the sheet joint point between the preceding steel sheet and the succeeding steel sheet can be limited to be low, thus avoiding the great change in coating weight.

However, with the method of controlling the urging forces between the rolls to the constant values as disclosed in the above-described Japanese Patent Laid-Open No. 6268/1983 and the like, the thickness of the coated film greatly changes according to the coating conditions such as the types of paints, the circumferential speed of the roll such as the applicator roll and the moving speeds of the steel sheets, so that it is difficult to control the thickness of the coated film to the constant value over the wide ranges of the coating conditions.

Further, rubber lined on the applicator roll is expanded and moistened by the thinner in the paint, whereby the elastic modulus (function of hardness) thereof is changed with time. Accordingly, when the urging force between the pickup roll and the applicator roll is set at a constant value, the expansion and moistening of the rubber progress, and the expansion and moistening are increased in degree, the surface pressure between the rolls is decreased, whereby the paint passing between the rolls is increased in quantities, thus increasing the thickness of the coated film.

Furthermore, in order to remove the influence due to the expansion and moistening of the rubber, it becomes necessary to perform the work for stabilizing the expansion and moistening (work for driving only the roll coater without performing the coating) for one or two hours until the expansion and moistening are stabilized, thus greatly deteriorating the production efficiency in this case.

Furthermore, with the method of controlling the urging force between the pickup roll and the applicator roll in accordance with the data in the past as disclosed in the above-described Japanese Patent Laid-Open No. 166959/1983 and the like, it is necessary to previously determine through experiments the conditions for setting at the predetermined values the types of paints, the degrees of dilution, the moving speeds of the steel sheets, the circumferential speeds of rolls, the target thickness of the coated film and the like, thus requiring much time and labor. Furthermore, in the case of this method, assurance is not obtained of that the change with time of the elastic modulus of the rubber of the applicator roll due to the expansion and moistening is always constant, so that no assurance can be obtained of the thickness of the coated film for the steel sheets used for motor vehicles, which require the strict accuracy in the thickness of the coated film.

Furthermore, with a method of controlling, wherein only the circumferential speed of the pickup roll, the circumferential speed of the applicator roll and the moving speeds of the steel sheets are evaluated and coefficients are determined experimentally through the regression, such problems are presented that a long period of time (one year, for example) is required before the stabilized control can be obtained, and moreover, the range of control to be applied is limited.

Further, for example, when the rear surface of the steel sheet is continuously coated by the second roll coater as shown in FIG. 43, if the method of reducing the ratio of sectional area between the preceding steel sheet and the succeeding steel sheet to a lower value is adopted, then, necessity for preparing a large quantity of connecting steel sheets occurs when the difference in the ratio of sectional area is large, and a period of time for threading the connecting steel sheets intervening becomes large, thus forming bottlenecks in improving the productivity.

SUMMARY OF THE INVENTION

The present invention has been developed to obviate the above-described disadvantages and has as its first object the provision of a method of controlling thickness of a coated film on a web-like member by a roll coater, capable of controlling at high accuracy the thickness of the coated film over wide ranges of coating conditions in coating the web-like member such as a steel sheet by the roll coater.

Furthermore, the present invention has as its second object the provision of a method of controlling thickness of a coated film on a web-like member by a roll coater, capable of controlling constantly the stabilized thickness of the coated film even when the degrees of the expansion and moistening of a elastic member such as rubber in an applicator roll are changed with time in coating the web-like member such as a steel sheet by the roll coater.

Further, the present invention has as its third object the provision of a method of controlling thickness of a coated film on a web-like member by a roll coater, wherein, in costing the rear surface of the web-like member, even when such a web-like member is used that which is obtained by connecting a first preceding web-like member to a second succeeding web-like member, said both web-like members being greatly different in sectional area from each other, the web-like member thus obtained is continuously conveyed in a suspended state, and the first and second web-like members can be coated with the uniform thickness of the coated film in coating while a suspended portion (catenary section) is supported by an applicator roll of the roll coater, without using a connecting web-like member for compensating a difference in sectional area between the first and the second web-like members.

To achieve the first object, according to the present invention, in a method of controlling thickness of a coated film on a web-like member by a roll coater, when a paint is transferred and coated on the continuously moving web-like member by the roll coater provided with an applicator roll, at least the surface of which is formed of an elastic material, the thickness of the film coated on the web-like member is controlled in accordance with a model equation which has evaluated a difference between a supply flow rate $q_A$ of the paint delivered to the side of the web-like member by rotation of the applicator roll and a leak flow rate $q_L$ remaining on the applicator roll without being transferred to the web-like member.

According to the present invention, furthermore, in the method of controlling the thickness of the coated film on the web-like member by the roll coater, a gap formed between the applicator roll and a front roll connected to the first stage of the applicator roll is determined by applying an elastohydrodynamic lubrication thereby, an equation for giving the supply flow rate $q_A$ is introduced by use of the gap, a gap formed between the applicator roll and the web-like member is determined by applying the elastohydrodynamic lubrication theory similarly, an equation for giving the leak flow rate $q_L$ is introduced by use of the gap, and the equation for giving the supply flow rate $q_A$ and the equation for giving the leak flow rate $q_L$ are applied to the model equation, to thereby further more securely achieve the above-described first object even when the thickness of the coated film is thin.

According to the present invention, furthermore, in the method of controlling the thickness of the coated film on the web-like member by the roll coater, an elastic modulus of the applicator roll included in the model equation is determined with time and the change with time is reflected on the control of the thickness of the coated film, to thereby achieve the above-described second object.

According to the present invention, further, in the method of controlling the thickness of the coated film on the web-like member by the roll coater when the web-like member is continuously conveyed in a suspended state and coated while the web-like member is supported by the applicator roll of the roll coater, when a connecting portion between a first web-like member and a second web-like member, which are different in size from each other, is passed over the roll coater, the tensions of the web-like members being changed with time are reflected on a film thickness control factor in the roll coater, to thereby achieve the above-described third object.

According to the present invention, furthermore, in the method of controlling the thickness of the coated film on the web-like member by the roll coater, at least the surface of the applicator roll is formed of an elastic material, a basic equation is set for evaluating the difference between the supply flow rate $q_A$ of a paint delivered to the side of the web-like member by rotation of the applicator roll and the leak flow rate $q_L$ remaining on the applicator roll without being transferred onto the web-like member, a gap formed between the applicator roll and a front roll connected to the first stage of the applicator roll is determined by applying an elastohydrodynamic lubrication theory, an equation for giving the supply flow rate $q_A$ is introduced by use of the gap, a gap formed between the applicator roll and the web-like member is determined by applying the elastohydrodynamic lubrication theory similarly, an equation for giving the leak flow rate $q_L$ is introduced by use of the gap, the equation for giving the supply flow rate $q_A$ and the equation for giving the leak flow rate $q_L$ are applied to the basic equation so as to prepare an equation for controlling the thickness of the coated film, and the tensions of the web-like members are reflected on a film thickness control factor included in the equation for controlling the thickness of the coated film, to thereby achieve the above-described third object similarly.

According to the present invention, the thickness of the film coated on the continuously moving web-like member is controlled in accordance with the film thickness control model equation which has evaluated the difference between the supply flow rate $q_A$ of a paint delivered to the side of the web-like member by rotation of the applicator roll and the leak flow rate $q_L$ remaining on the applicator roll after the paint is transferred onto the web-like member, whereby the control of the thickness of the coated film can be performed logically, so that the thickness of the coated film by the roll coater can be controlled at high accuracy and stably.

Furthermore, the gap formed between the applicator roll and the front roll positioned at the first stage of the applicator roll (in the roll coater having the pair of rolls, this front roll corresponds to the pickup roll) is determined by applying the elastohydrodynamic lubrication theory considering the elastic modulus of the elastic material included in the applicator roll, the supply flow rate $q_A$ is determined by use of the gap, the gap formed between the applicator roll and the web-like member is determined by applying the elastohydrodynamic lubrication theory similarly, the leak flow rate $q_L$ is determined by use of the gap, and, when these both flow rates $q_A$ and $q_L$ are applied to the above-described control model equation, for the coating having a very thin film thickness which is obtained in the negative state of the roll gap, the control of the film thickness can be performed at high accuracy and stably.

Further, when the elastic modulus included in the film thickness control model equation prepared by applying the elastohydrodynamic lubrication theory in calculating the supply flow rate $q_A$ and the leak flow rate $q_L$ is determined with time and the change with time is reflected on the film thickness control, the above-described elastic modulus is successively corrected on the basis of the measured values, so that the film thickness can be controlled constantly and accurately even when the degrees of the expansion and moistening of the elastic material included in the applicator roll are changed with time.

According to the present invention, furthermore, when the rear surface of the web-like member continuously conveyed in the suspended state is coated in the condition of being pushed up from below and supported by the applicator roll of the roll coater, the tension in the catenary section changing every moment while the Joint point, where the preceding web-like member and the succeeding web-like member which are different in sectional area from each other, passes through the catenary section, the value of the tension thus obtained is reflected on the film thickness control factor in the roll coater, so that the both preceding and succeeding web-like members can be coated with the uniform film thickness even when the difference in sectional area is large at the connecting point.

To state specifically, for example, the urging force (nip pressure) between the pickup roll and the applicator roll is controlled in association with the measured tension value, so that the coating weight of the coating can be held constant when the joint point passes through the catenary section.

Furthermore, in this case, the film thickness control equation which has evaluated under the elastohydrodynamic lubrication theory the gap formed between the pickup roll and the applicator roll and the gap formed between the applicator roll and the web-like member is applied to the film thickness control by the roll coater, so that coating can be performed with the uniform thickness even during the thin film coating.

Furthermore, instead of measuring the tension of the catenary section, the Joint point is tracked, and the tension set for suppressing the fluctuations of the catenary shape is used to control the urging force between the pickup roll and the applicator roll for example, the coated film thickness can be controlled with the coating weight being held constant.

BRIEF DESCRIPTION OF THE DRAWINGS

The preferred embodiments will be described with reference to the drawing, wherein like elements have been denoted throughout the figures with like reference numerals, and wherein.

DESCRIPTION OF THE PREFERRED EMBODIMENTS

Figure 1:
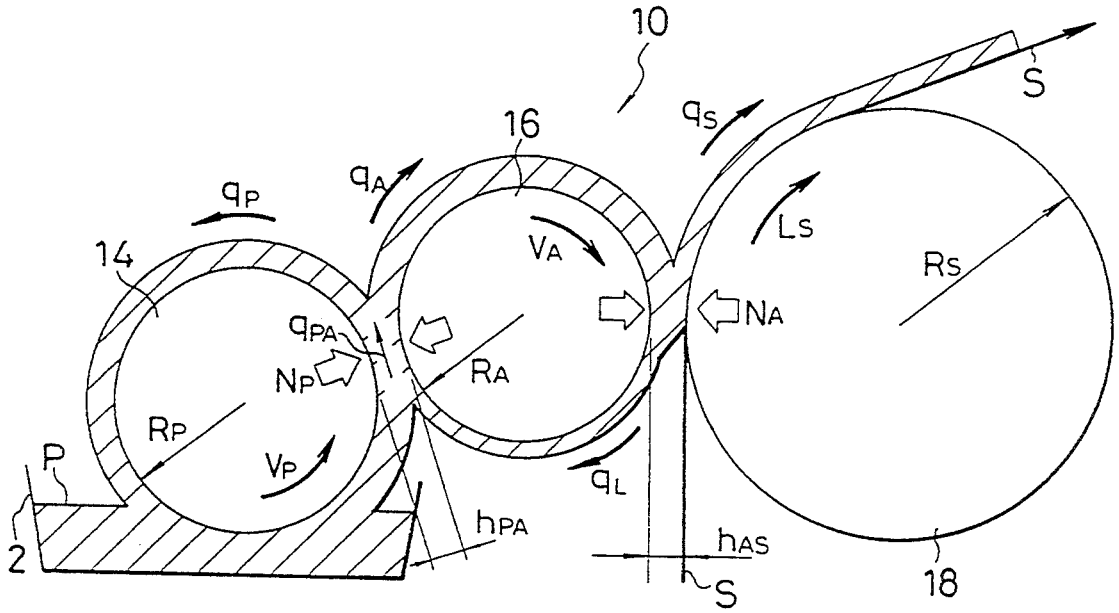
FIG. 1 is a schematic block diagram showing the roll coater applied to a first embodiment of the present invention.

The embodiments of the present invention will hereunder be described in detail with reference to the accompanying drawings. Incidentally, in the following description, the portions corresponding to these of the conventional techniques are designated by the same reference numerals in principle.

Figure 2:
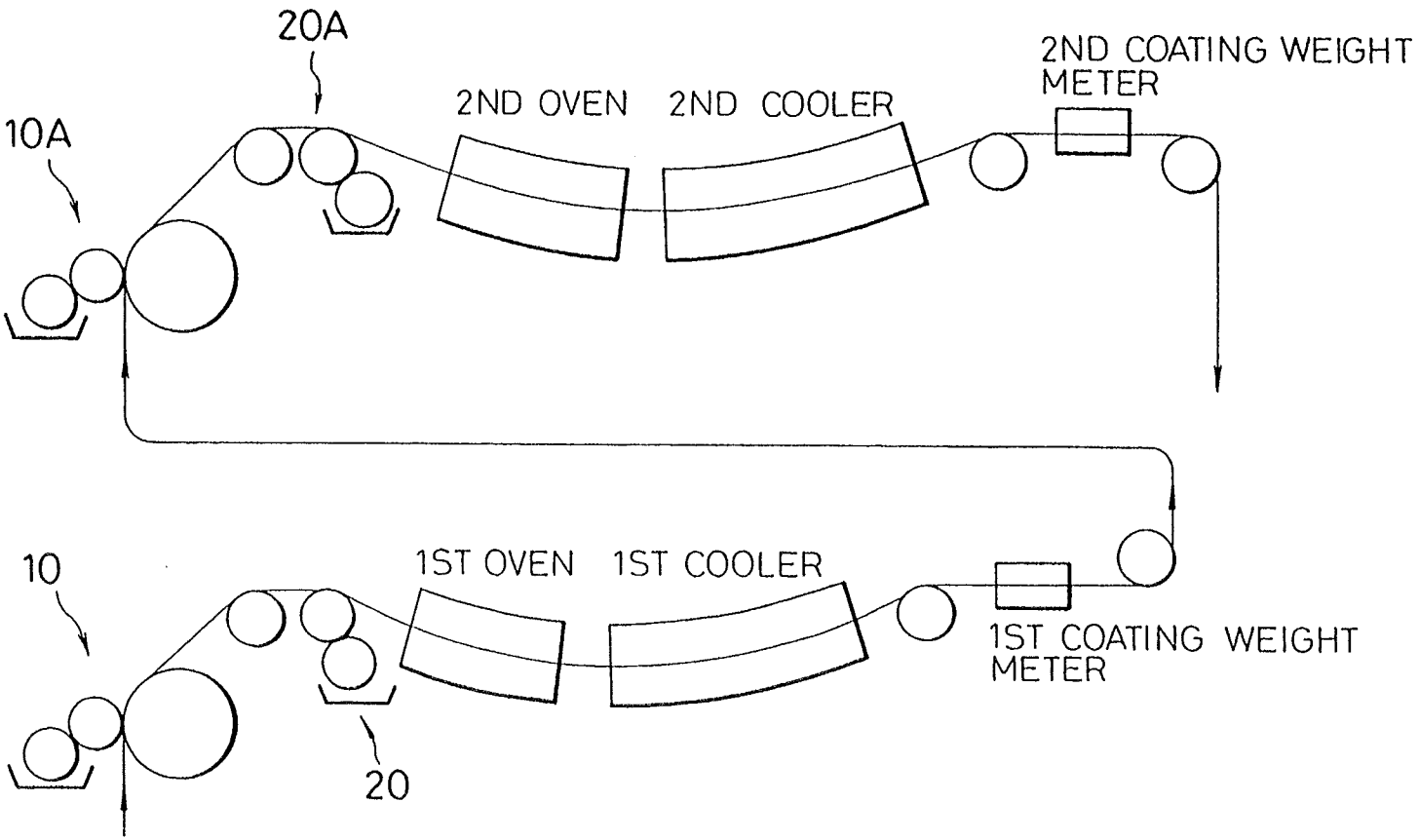
FIG. 2 is, a schematic explanatory view briefly showing the coating facility, to which the roll coater is applied.

FIG. 1 is a schematic block diagram showing the roll coater applied to a first embodiment of the present invention together with its function. FIG. 2 is a schematic explanatory view briefly showing one example of the coating facility, to which the roll coater is applicable. This coating facility corresponds to one shown in FIG. 43, in which two facilities are connectingly provided at the first stage and the last stage.

In general, coating on the steel sheet (web-like member) is performed in the flow shown in FIG. 2. Namely, a steel sheet S paid off from a payoff reel, not shown, in an inlet facility and passed through a degreasing process is conveyed to a first roll coater 10 and a second roll coater 20, which are located in a first stage facility for ground coating, thereafter, dried in a first oven, cooled in a first cooler, and thereafter, the coating weight is measured by a first coating weight meter.

The steel sheet S which has completed the ground coating in the above-described facility is given an upper surface coating similarly by a first roll coater 10A and a second roll coater 20A in the following last stage facility, thereafter, dried and cooled, respectively, in a second oven and a second cooler, thereafter, the coating weight is measured by a second coating weight meter, and thereafer, the steel sheet S is delivered to a wind-up reel, not shown, in an outlet facility for example, where the steel sheet S is wound up. Incidentally, depending on the types of products, the roll coaters having reference numerals 10, 10A, 20 and 20A are properly used for the case of only one surface coating, the case of omitting the ground coating and the like.

In this embodiment, when the front surface of the steel sheet S is coated by the roll coaters (which correspond to the first roll coaters 10, 10A in the first and last stage facilities as shown in FIG. 2) used in the above-described facilities or the like, the film thickness can be controlled at high accuracy.

The method of controlling the thickness of the coated film in this embodiment will be described in detail in conjunction of an example of the case where coating is performed by the roll coater 10 shown in FIG. 1.

The above-described roll coater 10 is constituted by a pickup roll 14 for picking up a paint P in a paint pan (paint pool) 12, an applicator roll 16 for picking up the paint in cooperation with the pickup roll 14, conveying part of the paint in a direction of the steel sheet S and transferring the paint onto the steel sheet S, and a backup roll 18 for urging the steel sheet S against the applicator roll 16 when the paint is transferred by the applicator roll 16.

The above-described pickup roll 14 is a steel roll having a radius $R_P$ and rotated at a circumferential speed Vp. The above-described applicator roll 16 is a roll, the surface of which is lined with rubber, having a radius $R_A$ and is rotated at a circumferential Speed $V_A$ in the forward direction to the pickup roll 14. In contrast thereto, the above-described backup roll 18 is a steel roll having a radius $R_S$ and rotated at a circumferential speed LS together with the steel sheet S in the reverse direction to the applicator roll 16.

In the above-described roll coater 10, when assumption is made that the gap formed between the pickup roll 14 and the applicator roll 16 is $h_{PA}$, the total flow rate $q_{PA}$ of the paint passing through this gap $h_{PA}$ is divided into two including the side of the pickup roll 14 and the side of the applicator roll 16. The paint build-up on the pickup roll 14 forms a return flow rate $q_P$ to be returned to the paint pan 12, and the paint build-up on the applicator roll 16 forms a supply flow rate $q_A$ to be delivered to the side of the steel sheet S.

When the supply flow rate $q_A$ is delivered to the steel sheet S, a part $q_S$ thereof (referred to as a strip flow rate) is transferred onto the steel sheet S, and simultaneously, the remaining part becomes a leak flow rate $q_L$ escaping through gap $h_{AS}$ formed between the applicator roll 16 and the backup roll 18.

Accordingly, when assumption is made that the coating weight (a solid coating weight per unit area which corresponds to the thickness of the coated film) after drying is M, the coating weight M on the steel sheet S coated under the strip flow rate $q_S$ can be given by the following equation (1). Incidentally the unit of the coating weight M is [g/m$^2$], $\gamma$ is a specific gravity of the paint and C a concentration of a solid content of the paint.

$$M=q_S'\gamma'C/LS \ldots \quad (1)$$

Since the above-described strip flow rate $q_S$ is equal to a difference between the supply flow rate $q_A$ and the leak flow rate $q_L$, the equation (1) may be turned into the following equation (2).

$$M=(q_A-q_L)'\gamma'C/LS \ldots \quad (2)$$

This embodiment performs the control of the thickness of the coated film by the roll coater 10, while adopting the above-described equation (2) as a basic model equation. The actual model equation is prepared by substituting a specific equation of $q_A$ and $q_L$ of the equation (2), which can perform the control. These supply flow rate $q_A$ and leak flow rate $q_L$ can be determined as follows.

The above-described roll coater 10 has relations to the following equations (3)–(5). Namely, there are shown that the equation (3) indicates that the total flow rate $q_{PA}$ is given by a product between the space formed between the pickup roll 14 and the applicator roll 16 and an average speed between the both rolls 14 and 16, the equation (4) indicates that the total flow rate $q_{PA}$ is a sum between the return flow rate $q_P$ and the supply flow rate $q_A$, and the equation (5) indicates that a distribution ratio of the total flow rate $q_{PA}$ (ratio between $q_A$ and $q_P$) is given by a ratio between the circumferential speeds of the above-described both rolls ($\alpha$ and $\beta$ are constant).

$$q_{PA}=h_{PA}(V_P+V_A)/2 \quad \ldots (3)$$

$$q_{PA}=q_P+q_A \quad \ldots (4)$$

$$q_A/q_P\alpha(V_A/V_P)^\beta \quad \ldots (5)$$

From the relations to the equation (3)–(5), the supply flow rate $q_A$ is given by the following equation (6).

$$q_A=[\alpha(V_A/V_P)^\beta/\{1+\alpha(V_A/V_P)^\beta\}]\times h_{PA}(V_A+V_P)/2 \quad \ldots (6)$$

On the other hand, the leak flow rate $q_L$ is given by the following equation (7) where $\lambda$ is a constant.

$$q_L=\lambda h_{AS}(V_A-LS) \quad \ldots (7)$$

The supply flow rate $q_A$ of the equation (6) and the leak flow rate $q_L$ of the equation (7) are substituted into the basic model equation (2), respectively, to thereby obtain the following specific model equation (8).

$$M=(\gamma C/LS)[\alpha(V_A/V_P)^\beta/\{1+\alpha(V_A/V_P)^\beta\}h_{PA}(V_A+V_P)/2-\lambda h_{AS}(V_A-LS)] \quad \ldots (8)$$

The above-described model equation (8) is effective when the respective gaps $h_{PA}$ and $h_{AS}$ are positively provided as predetermined values between the pickup roll 14 and the applicator roll 16 and between the applicator roll 16 and the steel sheet S, i.e., when the distance between the axes of the pickup roll 14 and the applicator roll 16 is larger than a sum of radii of the both rolls, a positive gap is formed between the both rolls and, similarly, a positive gap is formed between the applicator roll 16 and the steel sheet S.

Accordingly, the above-described model equation (8) is applicated to the film thickness control when the thickness of the coated film is relatively large.

Description will hereunder be given of a model equation applicable to the case where the distance between the axes of the pickup roll 14 and the applicator roll 16 is smaller than the sum of radii between the both rolls, i.e., the case where the gap formed between the pickup roll 14 and the applicator roll 16 is apparently negative. The phenomenon which the gap formed between the rolls becomes apparently negative occurs due to the fact that rubber lined on the applicator roll 16 experiences the deformation of shrinking a radial direction of the roll when the urging force between the rolls is strengthened to obtain a thin thickness of the coated film. This phenomenon similarly occurs between the applicator roll 16 and the backup roll 18, i.e., the steel sheet S.

When the rolls are strongly urged against each other to obtain the thin coated film as described above, a negative gap is formed between the rolls or between the roll and the steel sheet S, whereby no apparent roll gap is present. Therefore, the roll gap $h_{PA}$ and $h_{AS}$ included in the above-described model equation (8) are evaluated on the basis of the elastohydrodynamic lubrication theory and the values thus obtained are substituted into the equation (8), a new model equation is prepared which is applicable to the case where the apparent negative gap is formed between the pickup roll 14 and the applicator roll 16 or between the applicator roll 16 and the steel sheet S.

The above-described gap $h_{PA}$ is given by the following equation (9) according to an embodiment, to which the elastohydrodynamic lubrication theory is applied.

$$h_{PA}=3.1\mu^{0.6\prime}E_{EA}^{-0.4\prime}R_{PA}^{0.6\prime}(N_P/l)^{-0.2}\times\{(V_P+V_A)/2\}^{0.6} \quad \ldots (9)$$

Here, $$2/E_{Pa}=(1-\nu_P^2)/E_P+(1-\nu_A^2)/E_AR_{PA}=(R_P'R_A)/(R_P+P_A) \quad \ldots (10)$$

where $N_P$: nip pressure (total) between the rolls
l: length of roll surface
$E_P$ elastic modulus of the pickup roll
$\nu_P$ Poisson's ratio of the pickup roll
$E_A$: elastic modulus of the applicator roll
$\nu_A$: Poisson's ratio of the applicator roll Furthermore, the above-described gap $h_{AS}$ is given by the following equation (11) according to an embodiment, to which the elastohydrodynamic lubrication theory is applied similarly.

$$h_{AS}=3.1\mu^{0.6\prime}E_{AS}^{-0.4\prime}R_{AS}^{0.6\prime}(N_A/B)^{-0.2}\times\{(V_A-LS)/2\}^{0.6} \quad \ldots (11)$$

Here, $$2/E_{AS}=(1\nu_A^2)/E_A+(1-\nu_S^2)/E_S R_{AS}=(R_A'R_S)/(R_A+R_S) \quad \ldots (12)$$

where $N_A$: urging force (total)

B: sheet (strip) width $E_S$: elastic modulus of the sheet (strip)

$\nu_S$: Poisson's ratio of the sheet (strip)

$E_A$: elastic modulus of the applicator roll $\nu_A$: poisson's ratio of the applicator roll When the equations (9) and (11) are substituted into the equation (8) for arrangement, the following model equation (13) is obtained.

$$M = (3.1\cdot\gamma\cdot c\cdot\mu^{0.6}/LS)[\alpha(V_A/V_P)^{\beta}/\{1+\alpha(V_A/V_P)^{\beta}\}\times(N_P/l)^{-0.2}\cdot E_{PA}^{-0.4}\cdot R_{PA}^{0.6}\cdot\{(V_A+V_P)/2\}^{1.6}-\lambda(N_A/B)^{-0.2}\cdot E_{AS}^{-0.4}\cdot R_{AS}^{0.6}\cdot(1/2)^{0.6}\cdot(V_A-LS)^{1.6}] \quad (13)$$

Coating by the roll coater 10 is controlled by use of the above-described model equation (13), so that the thickness of the coated film can be accurately controlled even when the gap formed between the pickup roll 14 and the applicator roll 16 and the gap formed between the applicator roll 16 and the steel sheet S are apparently negative. The specific example of this result of control will hereunder be described in detail in conjunction with the other embodiment.

According to this embodiment, as described above, the model equation is theoretically introduced, so that the film thickness can be accurately controlled under the coating conditions over the wide ranges. Accordingly, when the coating conditions are changed, e.g., when the types of the used paints are changed, the coating can be easily controlled to a desirable film thickness.

Furthermore, in this embodiment, even when the viscosity and concentration of the paint is changed with time due to the evaporation, change in temperature and the like, the paint build-up onto the steel sheet S can be controlled at a constant value as described below.

Figure 3:
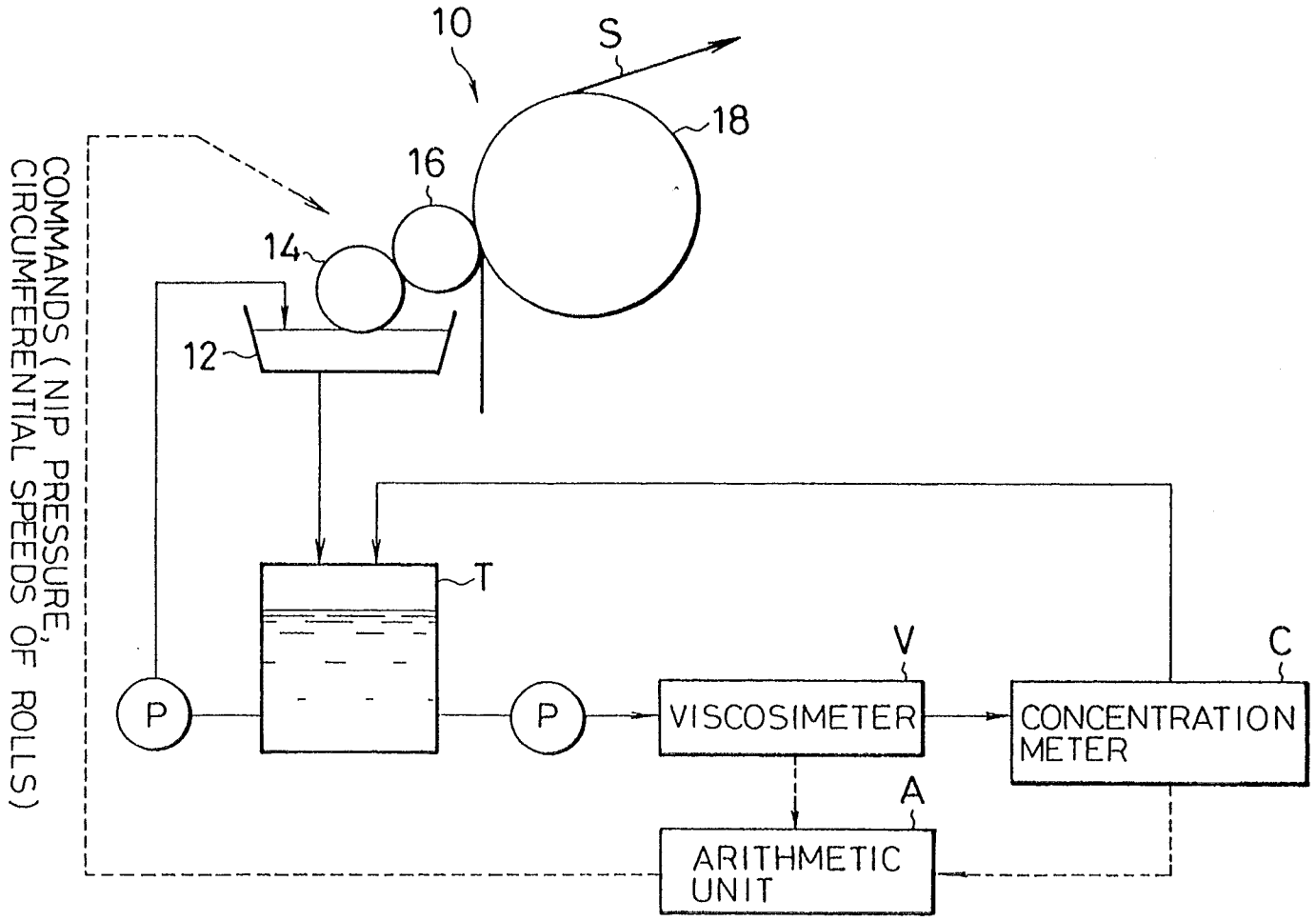
FIG. 3 is a explanatory view of coating control corresponding to change in paint quality.

Namely, as shown in FIG. 3 for example, a viscosimeter V and a concentration meter C which can measure on line are provided on a circulation tank T for supplying the paint to a paint pan 12 of the above-described roll coater 10, the viscosity and concentration of the paint are successively detected while the paint in the circulation tank T is circulated. The concentration member C can be, for example, a known X-ray fluoresence analyzer or a spectrophotometer depending on the type of paint. Subsequently, these detected values are input into an arithmetic unit A, and one command signal of at least one of a predetermined nip pressure and roll circumferential speed which are determined by carrying out the following operation in the arithmetic unit A is delivered to a driving device of the roll coater 10, to thereby feed forward-control the roll coater 10.

In the above-described arithmetic unit A, a measured viscosity $\mu$ and concentration C are substituted into the following equations (15) (16) obtained by deforming the following equation (14) showing the relationship between the viscosity $\mu$ and concentration C of the paint and the coating weight M, whereby a nip pressure $N_P$ and a roll circumferential speed $V_A$ are calculated, respectively.

$$M=C\mu^{0.6\prime}f(V_A,V_P,N_A,N_P,LS,E,R,\gamma) \quad \ldots (14)$$

where $V_P$: circumferential speed of the pickup roll $N_A$: urging pressure

LS: line speed

E: equivalent elastic modulus (corresponding to $E_{AS}$ in the equation (11))

R: equivalent roll radius (corresponding to $R_{AS}$ in the equation (11))

$\gamma$: specific gravity $$N_P=\{1/(C\mu^{0.6})\}\times f^{-1}(M,V_A,V_P,N_A,LS,E,R,\gamma) \quad \ldots (15)$$

$$V_A=\{1/(C\mu^{0.6})\}\times f^{-1}(M,V_P,N_A,N_P,LS,E,R,\gamma) \quad \ldots (16)$$

Figure 4:
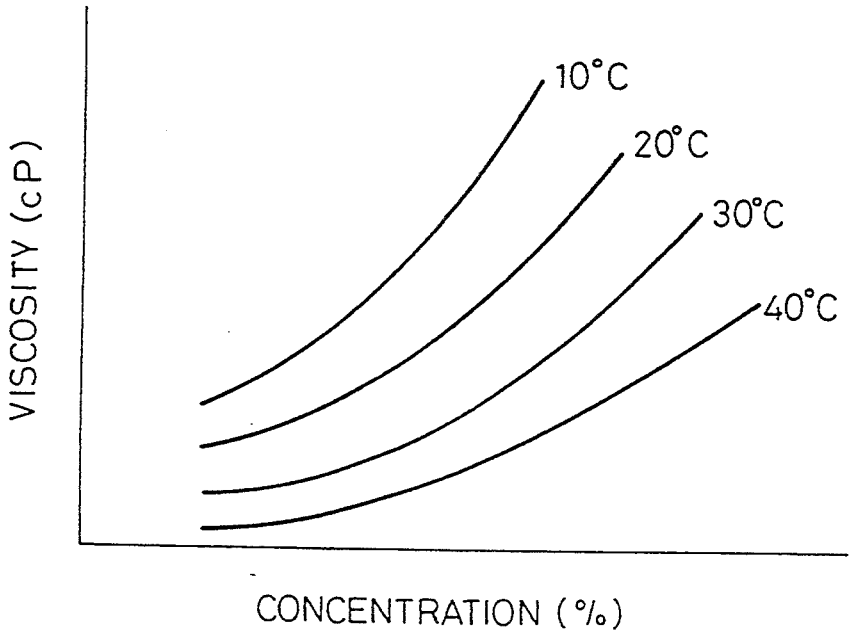
FIG. 4 is a diagram showing a relation between temperature, viscosity and concentration.

Incidentally, even when either the viscosimeter V or the concentration meter C is provided, a viscosity-concentration-temperature curve shown in FIG. 4, which has been previously measured, is input to the arithmetic unit A as a form of function or a table, if the viscosity is measured, then the concentration is calculated, and, if the concentration is measured, then the viscosity is calculated, and, the result is substituted into the above-described equation (15) or (16) similarly, whereby the feed forward control may be performed.

Figure 5:
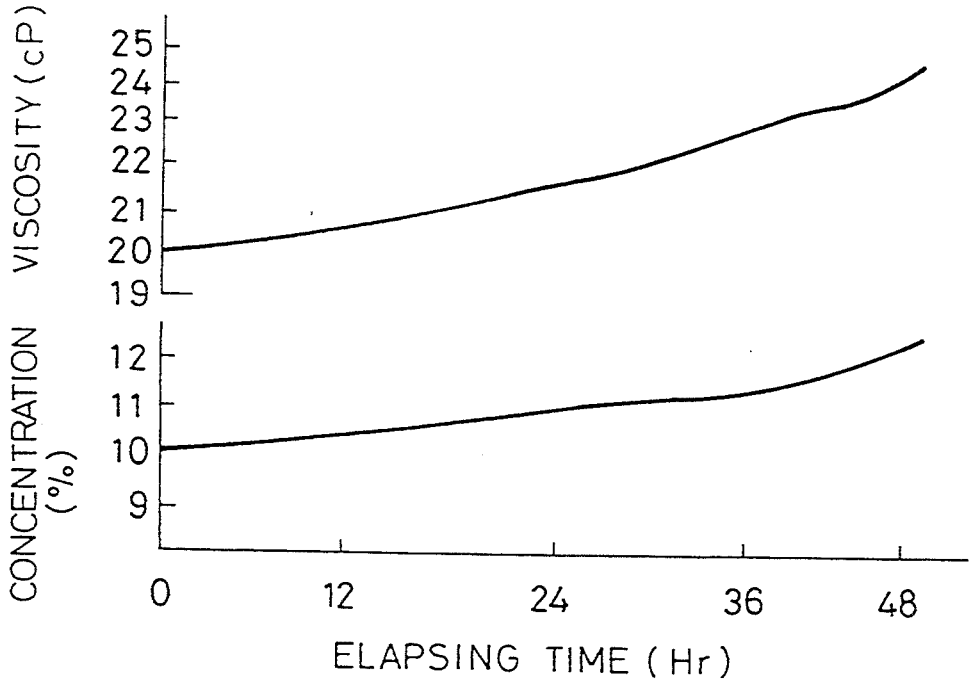
FIG. 5 is a diagram showing the change with time in paint quality.
Figure 6:
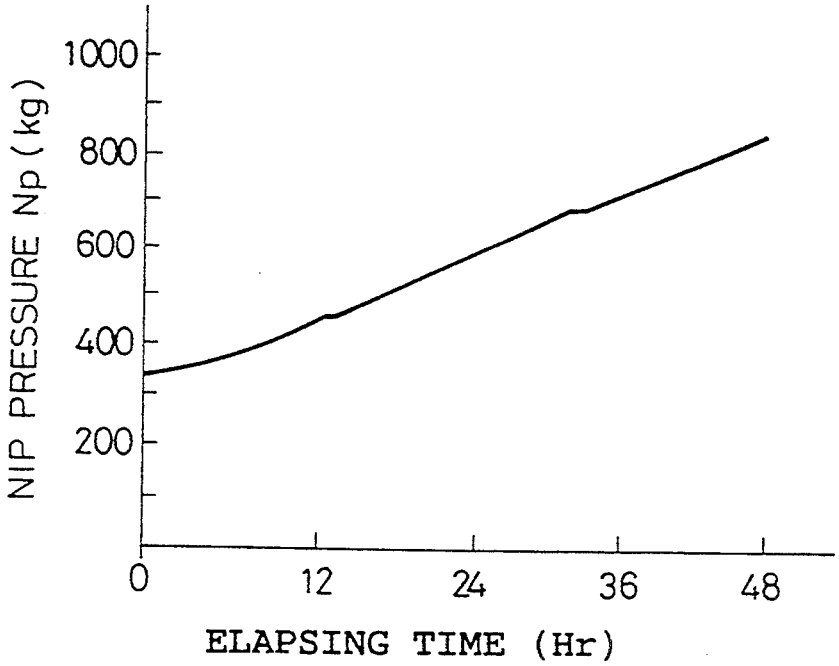
FIG. 6 is a diagram showing the change with time in nip pressure which is controlled according to the present invention.
Figure 7:
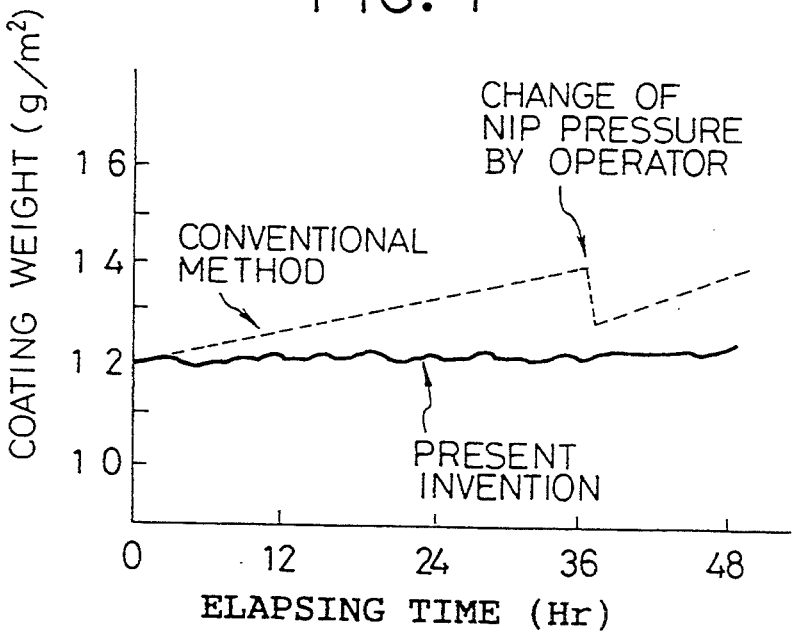
FIG. 7 is a diagram showing the effect of the present invention.

FIGS. 5–7 show the result obtained by applying the above-described feed forward control to the case where an organic solvent type paint having an initial concentration of 10%, an initial viscosity of 20 cP and a specific gravity of 0.92 is continuously coated for 48 hours when the viscosity and concentration are changed with time. A target coating weight is 1.2 + or −0.2 g/m .

Coating conditions include LS=30 mpm, $V_A$=80 mpm, $V_P$=40 mpm, $N_A$=100 kg/one side, $N_P$=344 kg/one side, roll radii of a pickup roll=$\phi$ 300, an applicator roll=$\phi$ 300, a backup roll=$\phi$ 900, and the hardness of rubber on the applicator roll=52°.

As shown in FIG. 5, the quality of the paint was changed with time, and, after 48 hours, the concentration was 11%, viscosity 24 cP and specific gravity 0.92. As the result of applying the above-described feed forward control and controlling the nip pressure $N_P$ as shown in FIG. 6, the coating weight was able to be controlled at substantially the predetermined value as shown in FIG. 7.

Furthermore, when the model equation (13) is used, even if the degrees of the expansion and moistening of the rubber lined on the applicator roll 16 are changed with time and the elastic modulus (Young's modulus) is changed with time, it is possible to follow the change and control with a predetermined film thickness. Namely, while an equivalent elastic modulus $E_{PA}$ between the pickup roll 14 and the applicator roll 16 and an equivalent elastic modulus $E_{AS}$ between the applicator roll 16 and the steel sheet S, which are included in the model equation (13), are used, an elastic modulus $E_A$ (elastic modulus of the applicator roll) successively changing due to the expansion and moistening of the rubber is measured and corrected in accordance with the above-described equations (10) and (12), so that the model equation (13) can be amended while the changes with time of the both equivalent elastic module $E_{PA}$ and $E_{AS}$ are evaluated.

As an example of a method of specific measuring of $E_A$, there is a method, in which the urging force (nip pressure) $N_P$ between the pickup roll 14 and the applicator roll 16 and the distance between the axes of the both rolls are detected, and $E_A$ is calculated from the both detected values, and so forth.

Therefore, according to this embodiment, as in the case where the applicator roll of the roll coater 10 is exchanged, even when the degrees of the expansion and moistening of the rubber lined on the applicator roll 16 are changed every moment, the film thickness can be accurately controlled to a desirable value. A specific example of the result of this control will be described in detail later.

Figure 43:
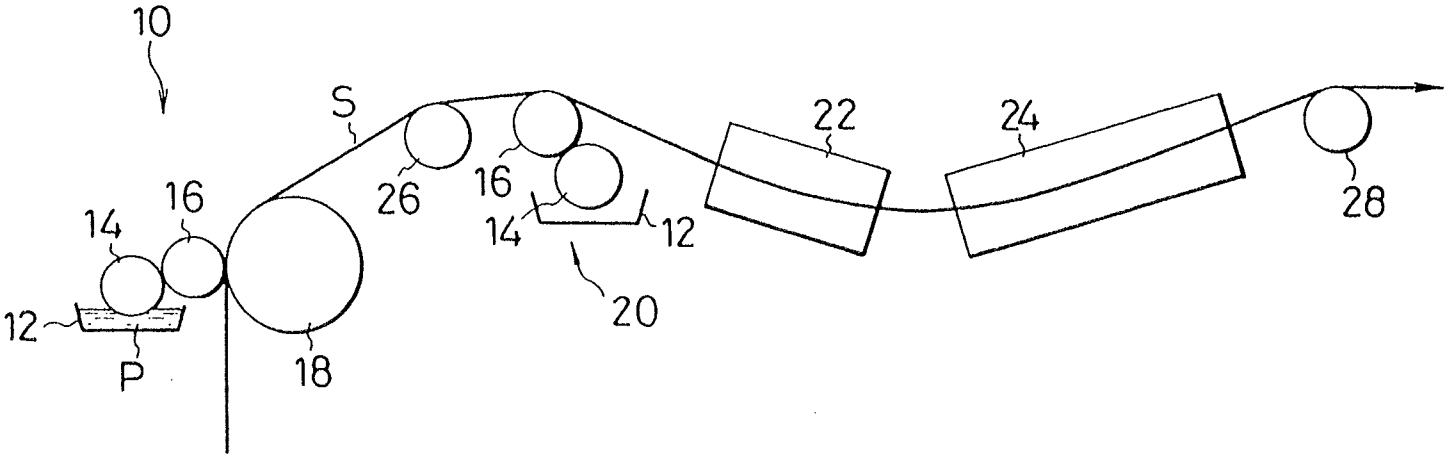
FIG. 43 PRIOR ART
FIG. 43 is a chart typically showing an example of the coating line.
Figure 44:
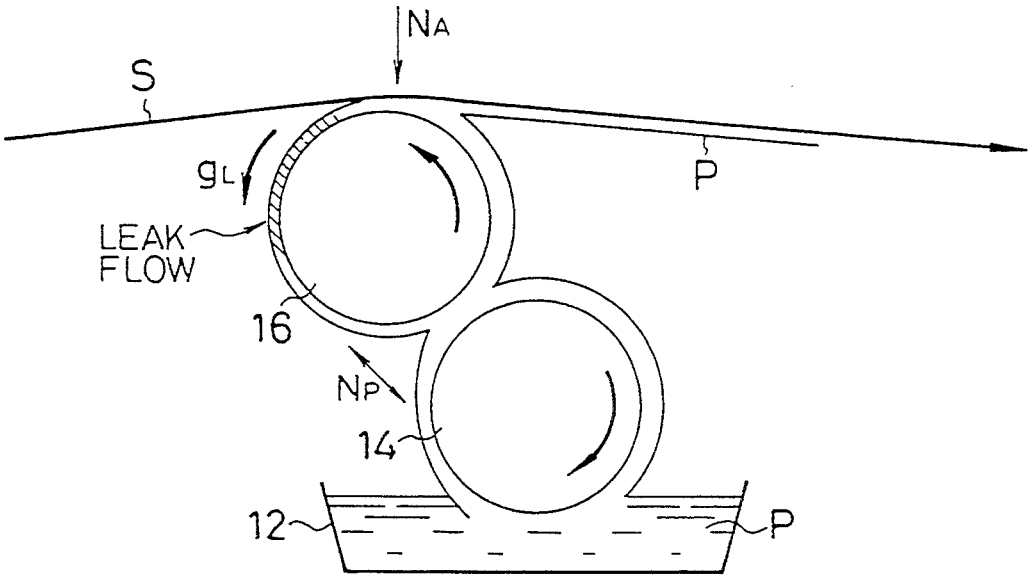
FIG. 44 PRIOR ART
FIG. 44 is a schematic explanatory view showing the state of the coating of the rear surface of the steel sheet S.
Figure 45:
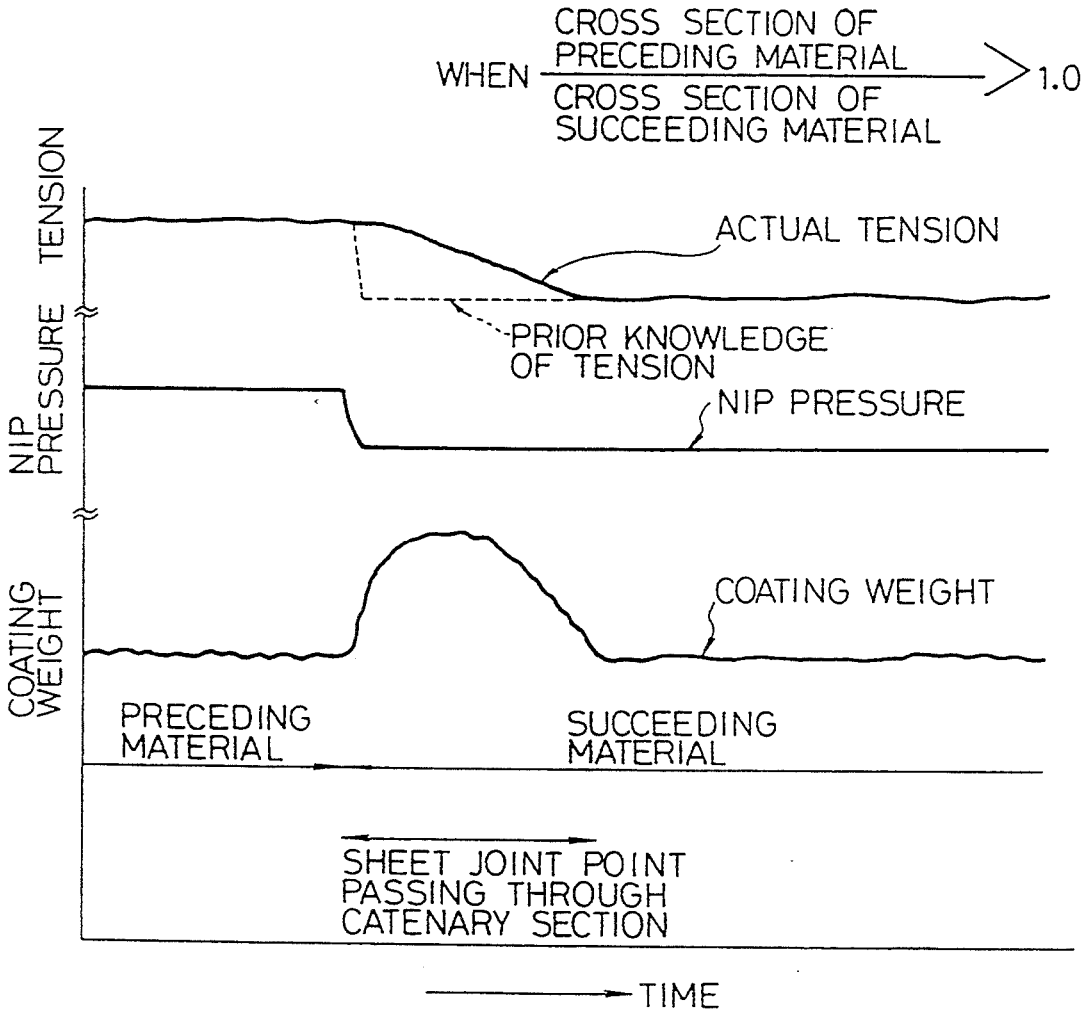
FIG. 45 PRIOR ART
FIG. 45 is a chart showing the changes with time of the tension, the nip pressure and the coating weight according to the conventional method.

A second embodiment of the present invention will hereunder be described. This embodiment shows a method of controlling the thickness of the coated film when such a facility is used that another roll coater 20 is provided in the back of the roll coater 10 used in the first embodiment, and both the front and the rear surfaces of the steel sheet S are successively coated. Incidentally, reference numeral 26 in the drawing designates a lift roll for correcting an angle of winding the steel sheet S onto the applicator roll 16 as shown in FIG. 43.

When the front surface of the steel sheet S is coated by the roll coater 10 (hereinafter referred to as the first roll coater) in the first stage, control of the thickness of the coated film can be performed similarly to the first embodiment, and, when the rear surface is coated by the roll coater 20 (hereinafter referred to as the second roll coater) in the last stage, the film thickness can be controlled by applying the above-described model equation (8) or (13) similarly to the first embodiment.

However, in the first roll coater, the steel sheet S externally contacts the applicator roll 16, whereas, in the second roll coater 20, the steel sheet S internally contacts the applicator roll 16, whereby the following equation (17) is adopted for an equivalent roll radius $R_{AS}$ between the applicator roll 16 and the steel sheet S as shown in the equation (13). In this case, a radius $R_S$ of the backup roll is regarded as a radius of curvature of the steel sheet S, and an urging pressure $N_A$ is determined from a tension of the steel sheet S.

$$R_{AS}=R_A'R_S/(R_S-R_A) \quad \ldots (17)$$

Figure 9:
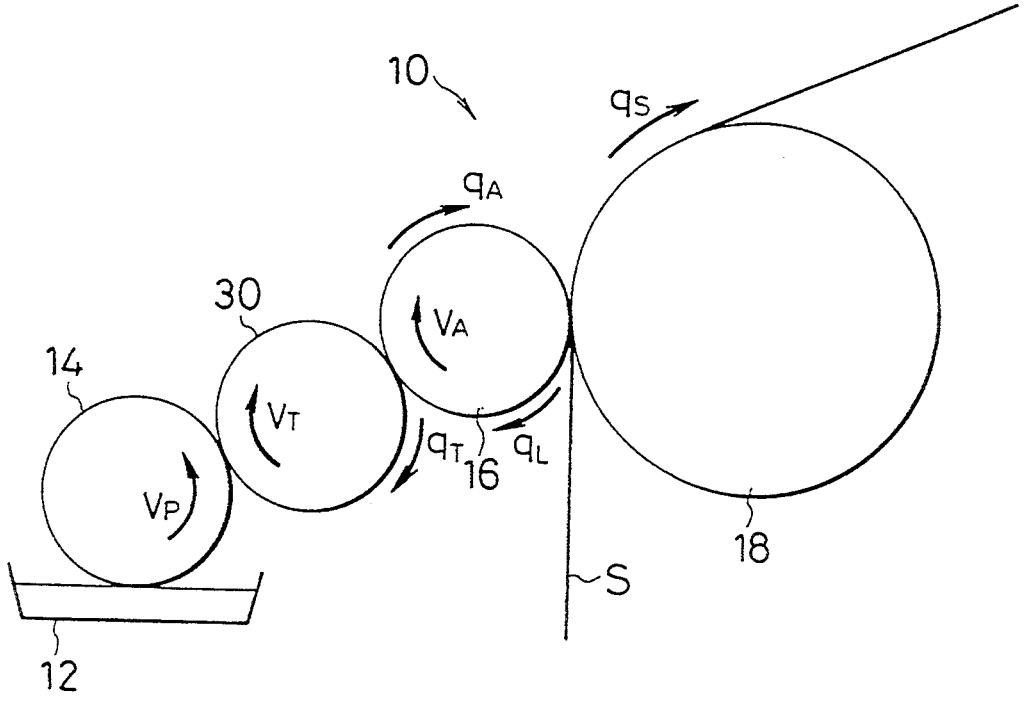
FIG. 9 is a schematic block diagram showing the roll coater applied to a third embodiment of the present invention.

FIG. 9 is a schematic block diagram showing the roll coater applied to a third embodiment of the present invention.

In the above-described roll coater 10, a transfer roll 30 is interposed between the pickup roll 14 and the applicator roll 16, and the side of paint supply is constituted by triplet rolls. Even in the case of the roll coater 10 including the triplet rolls, for the control of the thickness of the coated film, the model equation substantially identical with the equation (8) or (13) is applicable.

In that case, when supposition is made that a leak flow rate in the transfer roll is made to be $q_T$, $q_S$ in the equation (1) becomes $q_A-q_L-q_T$, a basic model equation corresponding to the above-described equation (2) is given by the following equation (18).

$$M=(q_A-q_L-q_T)'\gamma'C/LS \quad \ldots (18)$$

Incidentally, it is not shown though, even if the rolls on the side of paint supply are quadruple or more, the above-described model equation is applicable similarly. In that case, the following principle is applied.

When there are two rolls including a front roll 1 and a rear roll 2, which are connected to each other, a flow rate $q_2$ delivered to the rear roll 2 from the front roll 1 is calculated as follows (the flow rate $q_2$ corresponds to a supply flow rate $q_A$ when the rear roll 2 is an applicator roll).

Figure 10A:
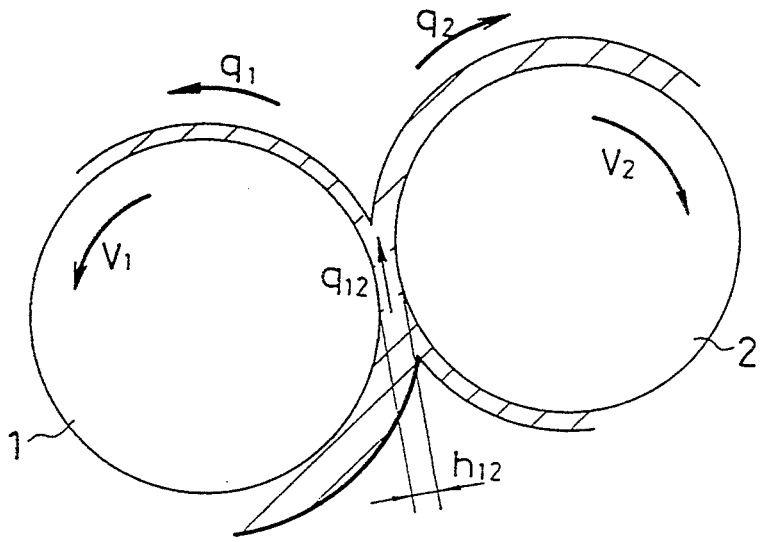
FIGS. 10A and 10B are explanatory views explaining the relationship between the rotary directions of the roll costituting the applicator roll and the flow rate of the paint.

As shown in FIG. 10A, when the front roll 1 and the rear roll 2 are rotated in the forward direction, the same relation as shown in the above-described equations (3)–(5) is established, whereby the above-described flow rate $q_2$ is given by the following equation (19) corresponding to the equation (6).

$$q_2[\alpha(V_2/V_1)^\beta/\{1+\alpha(V_2/V_1)^\beta\}]\times h_{12}(V_2 30\ V_1)/2 \quad \ldots (19)$$

Figure 10B:
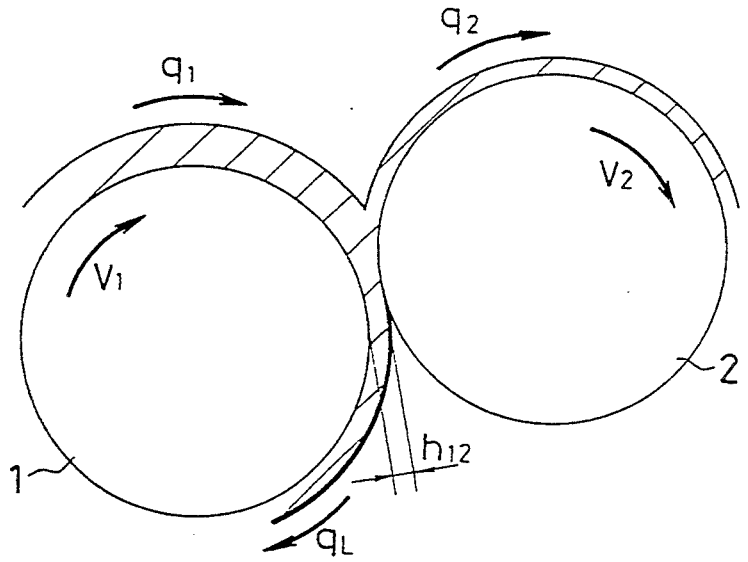
Figure 11:
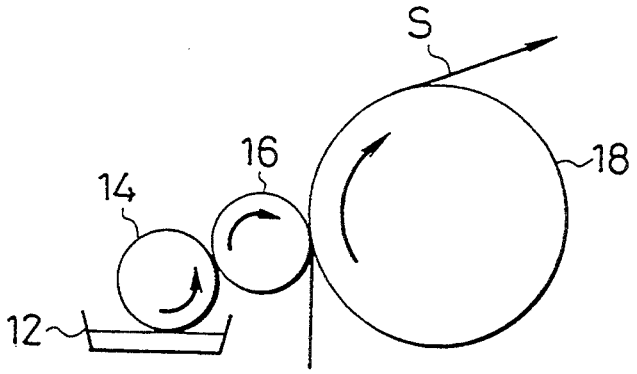
FIG. 11 is an explanatory view showing an example of the combination of the rotary directions of the respective rolls constituting the roll coater.
Figure 12:
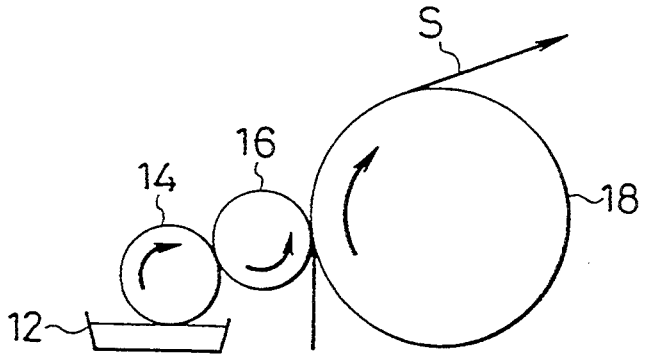
FIG. 12 is an explanatory view showing another example of the combination of the rotary directions of the respective rolls constituting the roll coater.

On the contrary, the front roll 1 and the rear roll 2 are rotated in the reverse direction as shown in FIG. 10B, the relation of the equation (7) is established, whereby the above-described flow rate $q_2$ is given by the following equation (20).

$$q_2=q_1-\lambda h_{12}(V_1-V_2) \quad \ldots (20)$$

The above-described model equation (8) and (13) are prepared in consideration of the relations in the equations (19) and (20), whereby the above-described model equation becomes applicable irrespective of the number of the rolls connected to one another and of the forward or reverse direction of rotation.

Since the relations in the above-described equations (19) and (20) are established between the applicator roll and the steel sheet S, the model equations are similarly applicable when the applicator roll is rotated in the forward direction to the moving direction of the steel sheet S. Specifically, the above-described model equations (8) and (13) are applicable even to the roll coater operated in the combination of the rotary directions shown in FIGS. 11–20 for example.

The result of the actual control of the film thickness using the equation (13) are shown in FIGS. 21–29. These results of the control as shown in these FIGS. 21–29 are obtained through the actual coating by changing the coating conditions, respectively, and these coating conditions are shown the following table 1.

TABLE 1

| Figure No. | Roll coater types | Used Paint | | |
|---|---|---|---|---|
| | | Concentration | Viscosity | Specific gravity |
| 21 | A | 3 | 1 | 1.0 |
| 22 | A | 10.5 | 8 | 1.0 |
| 23 | A | 14 | 3.1 | 1.0 |
| 24 | B | 14 | 3.1 | 1.0 |
| 25 | A | 10 | 32 | 0.83 |
| 26 | B | 10 | 32 | 0.83 |
| 27 | A | 1.3 | 1 | 1.0 |
| 28 | B | 1.3 | 1 | 1.0 |
| 29 | C | 3 | 1 | 1.0 |

Figure 8:
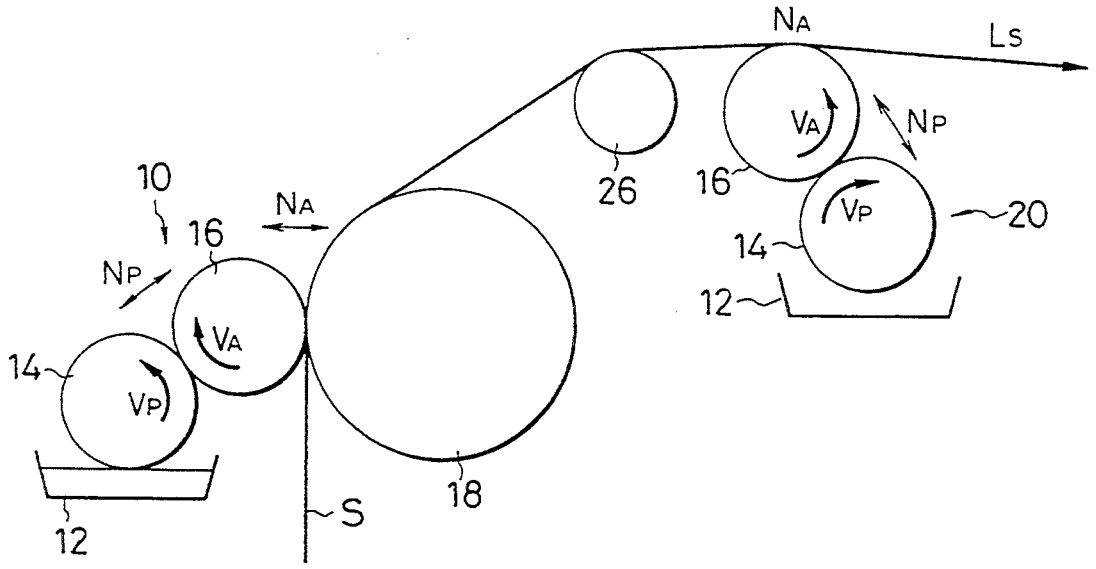
FIG. 8 is a schematic explanatory view showing the arrangement of the roll coaters applied to a second embodiment of the present invention.
Figure 13:
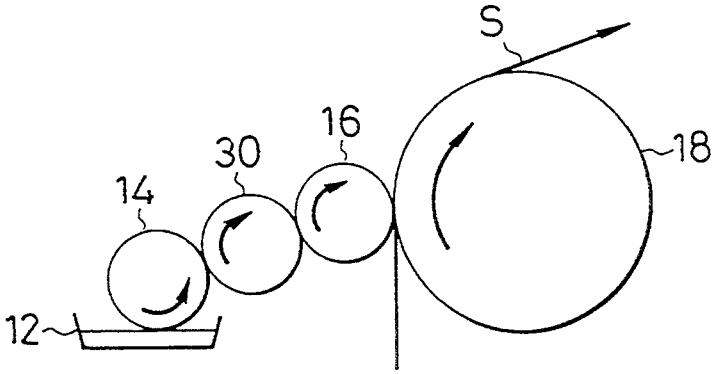
FIG. 13 is an explanatory view showing a further example of the combination of the rotary directions of the respective rolls constituting the roll coater.
Figure 14:
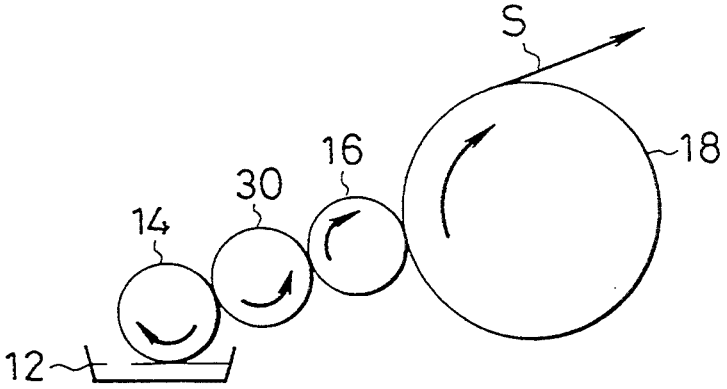
FIG. 14 is an explanatory view showing a still further example of the combination of the rotary directions of the respective rolls constituting the roll coater.
Figure 15:
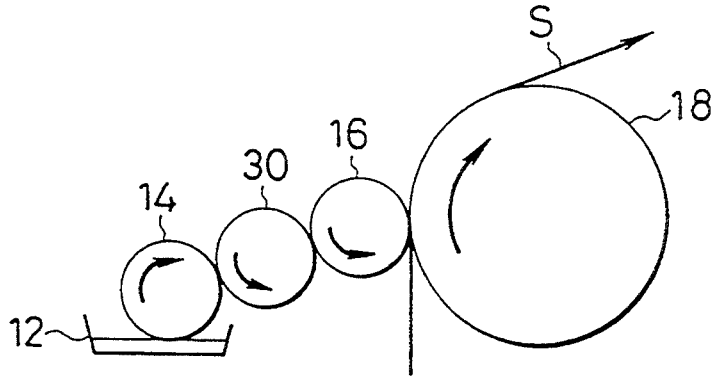
FIG. 15 is an explanatory view showing a still more further example of the combination of the rotary directions of the respective rolls constituting the roll coater.
Figure 16:
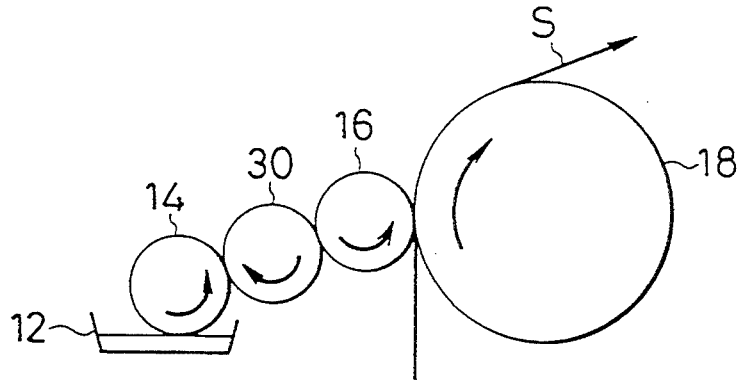
FIG. 16 is an explanatory view showing a yet further example of the combination of the rotary directions of the respective rolls constituting the roll coater.
Figure 17:
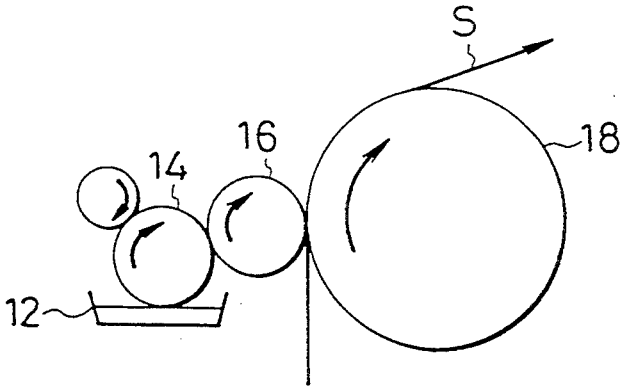
FIG. 17 is an explanatory view showing a yet further example of the combination of the rotary directions of the respective rolls constituting the roll coater.
Figure 18:
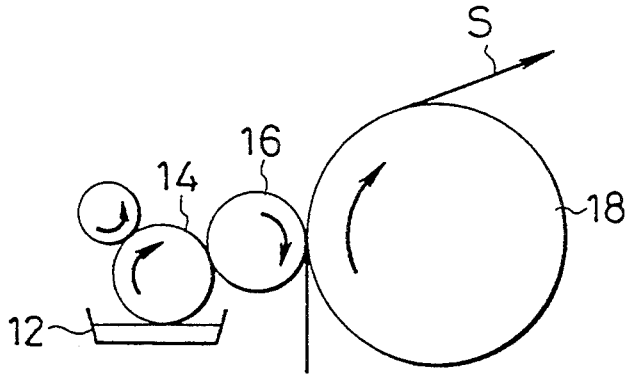
FIG. 18 is an explanatory view showing a yet further example of the combination of the rotary directions of the respective rolls constituting the roll coater.
Figure 19:
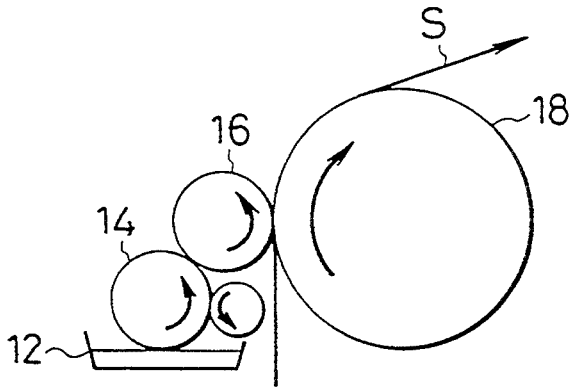
FIG. 19 is an explanatory view showing a yet further example of the combination of the rotary directions of the respective rolls constituting the roll coater.
Figure 20:
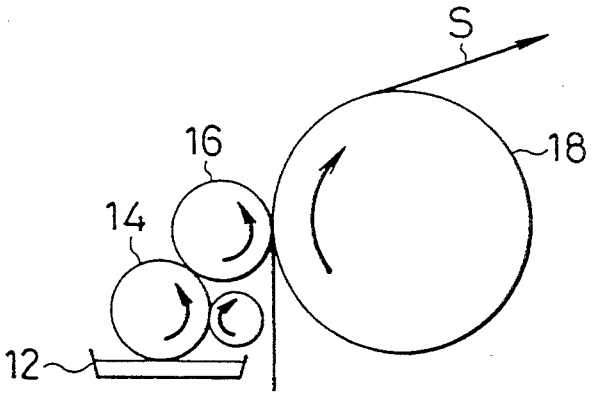
FIG. 20 is an explanatory view showing a yet further example of the combination of the rotary directions of the respective rolls constituting the roll coater.

In a column of the roll coater types in the Table 1, there are shown that A indicates the use of the roll-coater shown in the above-described FIG. 1 (which is identical with the first roll coater as shown in FIG. 8), B the use of the second roll coater of the last stage as shown in FIG. 8 and C the use of the roll coater shown in FIG. 13, respectively.

Figure 21:
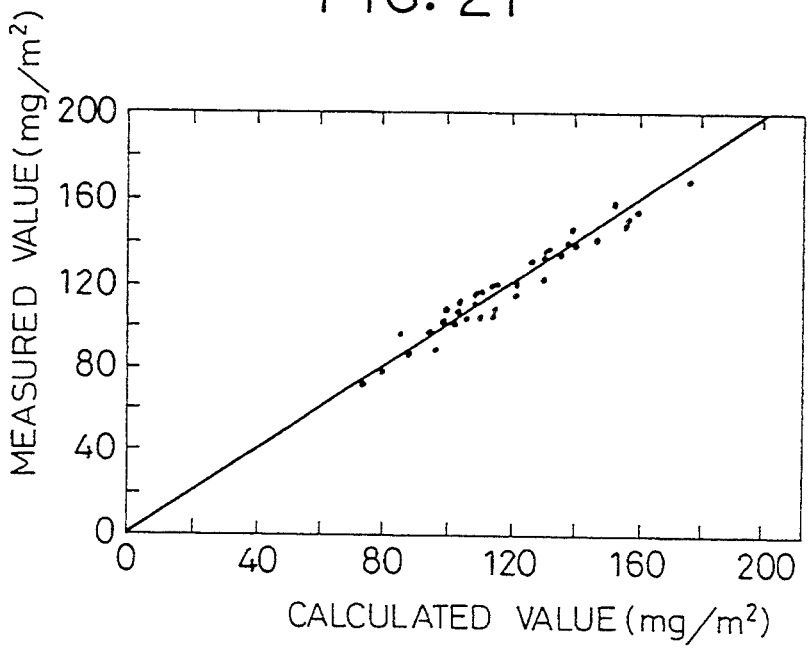
FIG. 21 is a chart showing the effect of the present invention.
Figure 22:
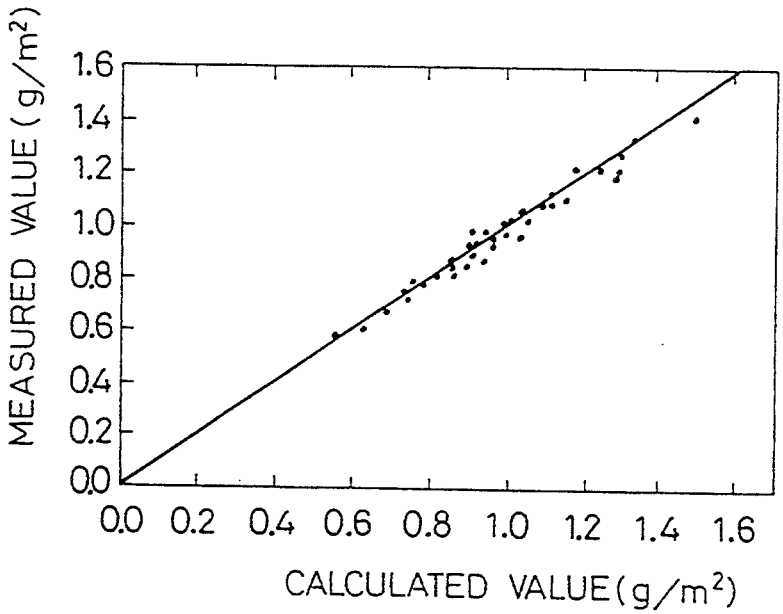
FIG. 22 is another chart showing the effect of the present invention.
Figure 23:
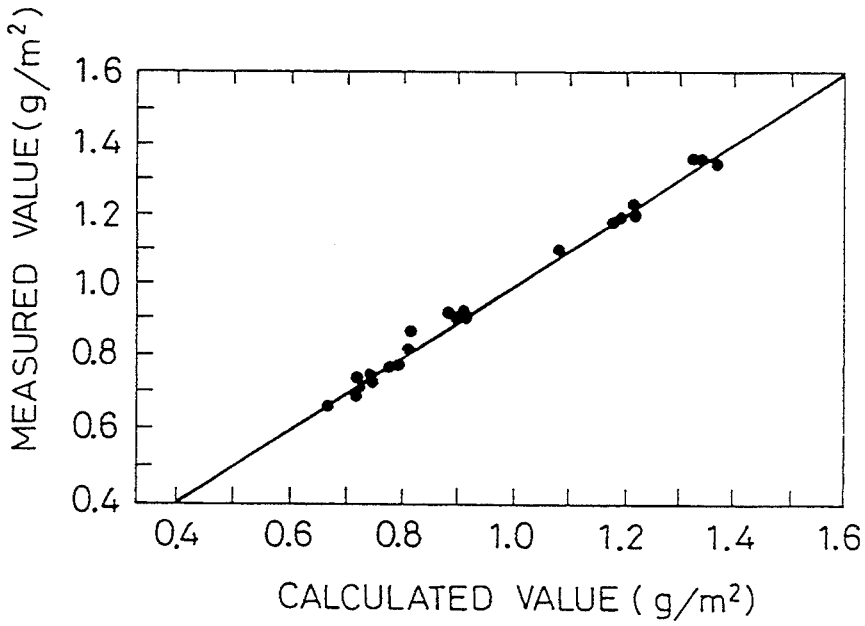
FIG. 23 is a further chart showing the effect of the present invention.
Figure 24:
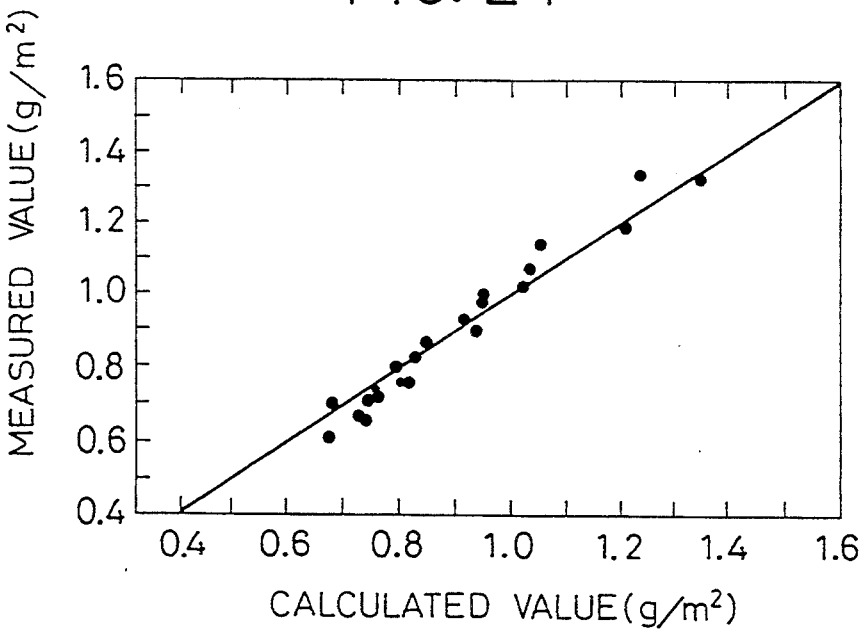
FIG. 24 is a still further chart showing the effect of the present invention.
Figure 25:
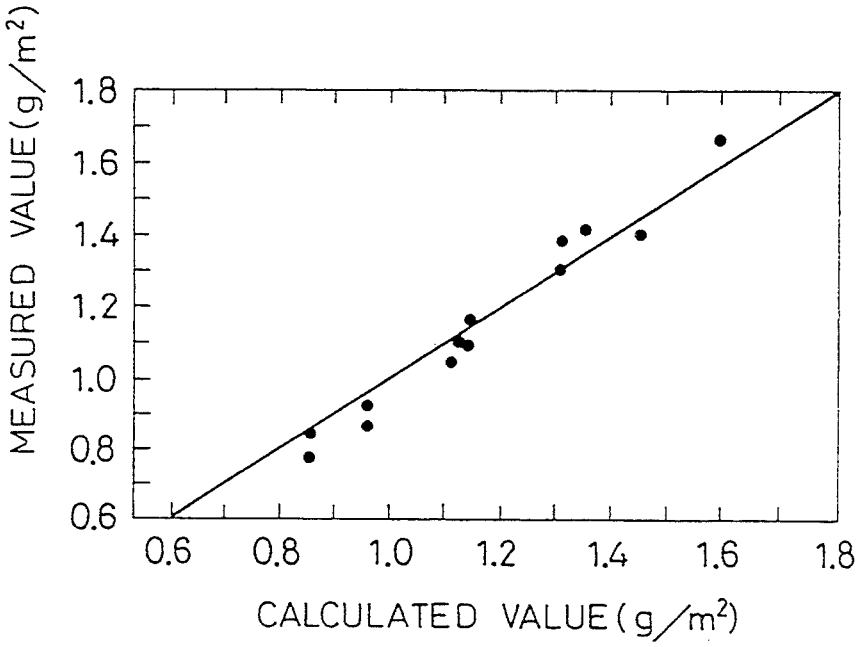
FIG. 25 is a still more further chart showing the effect of the present invention.
Figure 26:
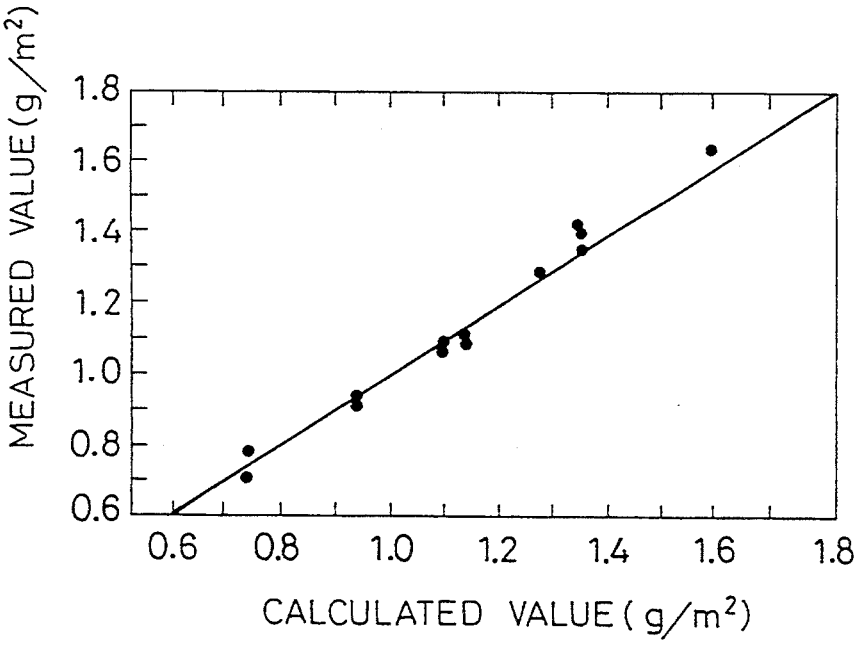
FIG. 26 is a yet further chart showing the effect of the present invention.
Figure 27:
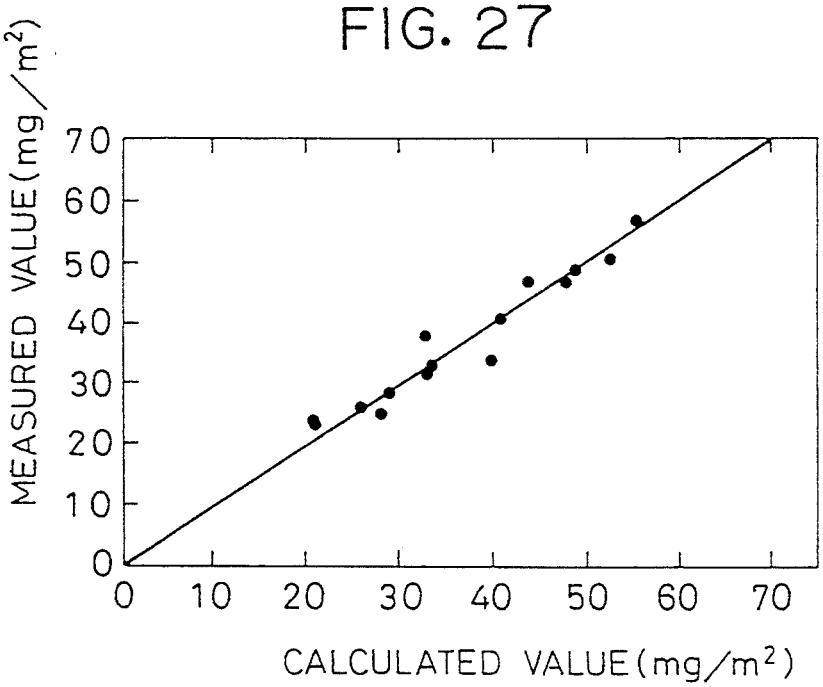
FIG. 27 is a yet further chart showing the effect of the present invention.
Figure 28:
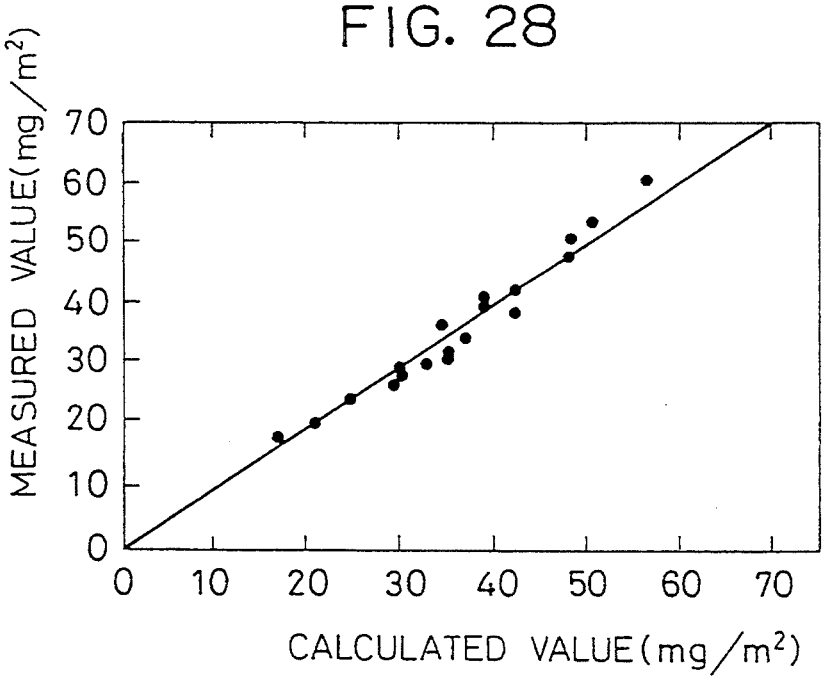
FIG. 28 is a yet further chart showing the effect of the present invention.
Figure 29:
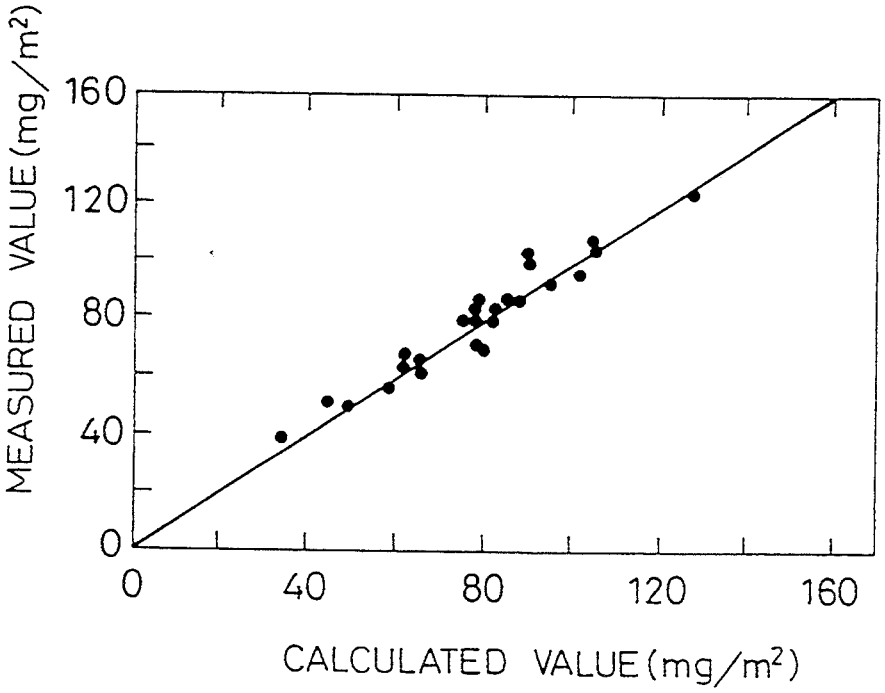
FIG. 29 is a yet further chart showing the effect of the present invention.

Parts of the result of the control and the conditions as described in the Table 1 will be specifically explained. FIG. 21 shows the result of the coating, in which the roll coater of type A is used and a paint having the concentration of 3%, viscosity of 1 cP and specific gravity of 1.0 is coated on the steel sheet S, and FIG. 22 shows the result of the coating, in which the roll coater of type A is used similarly and a paint having the concentration of 10.5%, viscosity of 8 cP and specific gravity of 1.0 is coated on the steel sheet S. Furthermore, FIG. 24 shows the result of the coating, in which the roll coater of type B is used and a paint having the concentration of 14%, viscosity of 3.1 cP and specific gravity of 1.0 is coated on the steel sheet S.

From the above-described FIGS. 21–29, it is clear that, as for the coating weight (film thickness) after the drying, the calculated values (abscissa) coincide well with the measured values (ordinate), from which it is found that the present invention is effective over the wide ranges of the coating conditions.

Description will hereunder be given of the example of the control of the thickness of the coated film according to the present invention when the line speed is changed.

In this example of the control, there were used a pair of roll coaters including the first roll coater (type A) and the second roll coater (type B) arranged similarly to FIG. 8 in the above-described second embodiment. An object to be coated was a steel sheet having a thickness of 0.5 mm and a width 1220 mm. As a paint, a water-soluble paint having the concentration of 14%, viscosity of 3.1 cP and specific gravity of 1.0 was used.

Figure 30A:
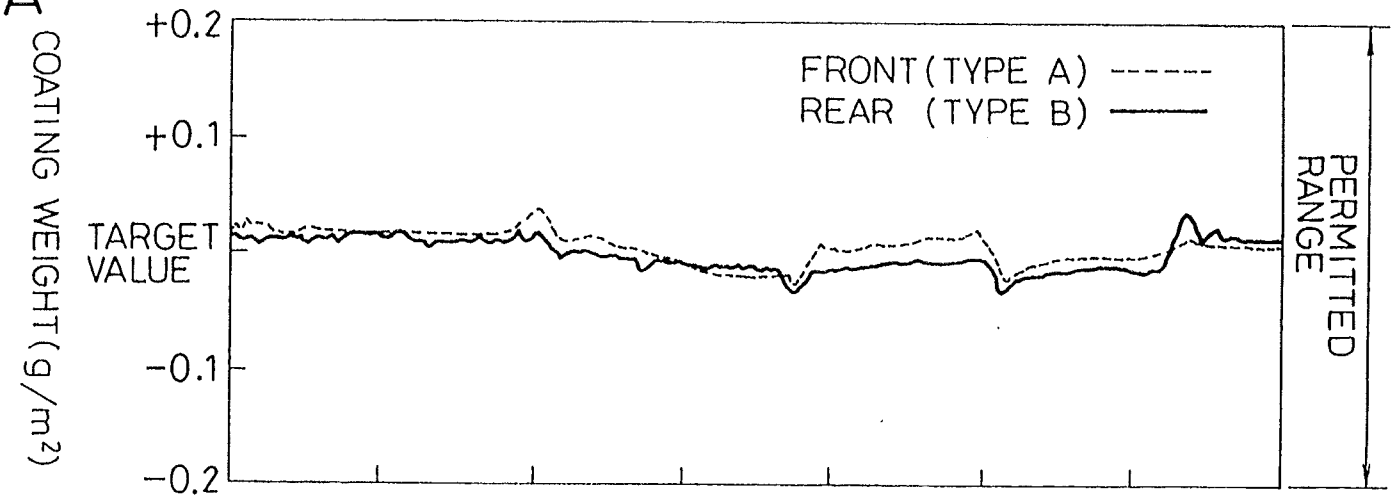
FIGS. 30A and 30B are charts showing the coating weight and the line speed when the line speed is changed.
Figure 30B:
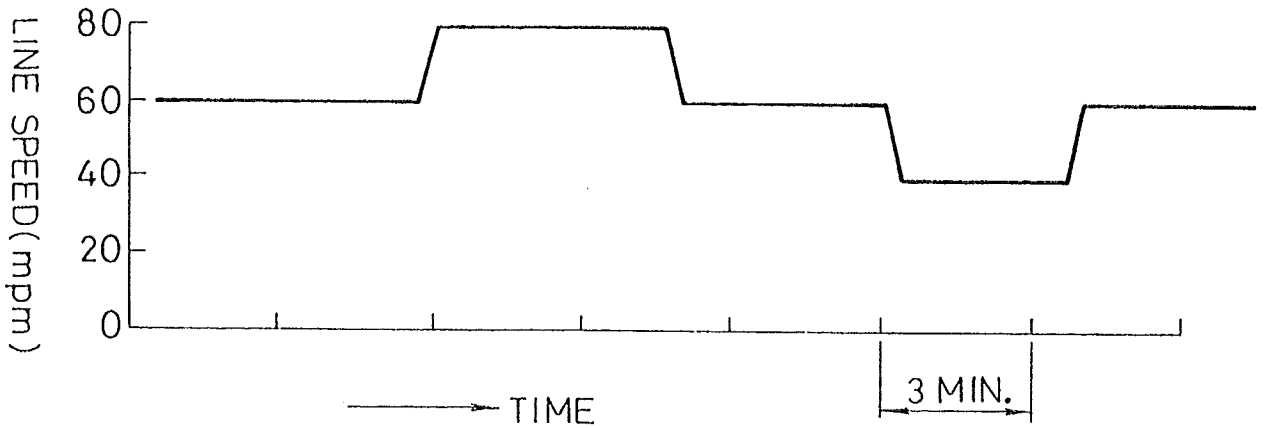

FIG. 30(A) shows the result of the case where, when the line speed (mpm) is changed in the order of 60-80-60-40-60 as shown in FIG. 30(B), the present invention is applied to control the thickness of the coated film. In the drawing, a two-dot chain line indicates the coating weight (film thickness) with time on the front side coated by the first roll coater, and a solid line indicates the coating weight with time on the rear side coated by the second roll coater, respectively.

Figures 31A, 31B:
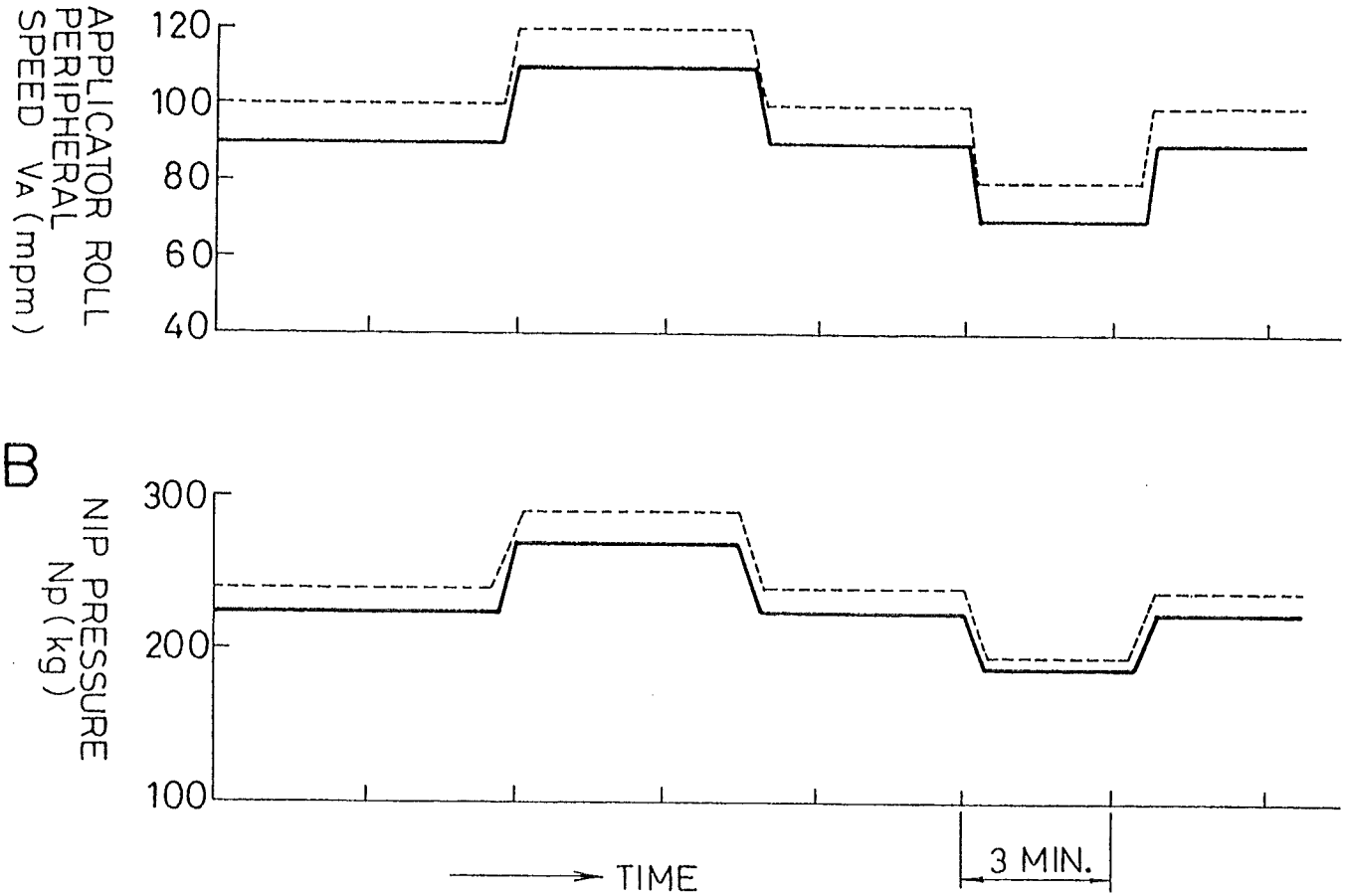
FIGS. 31A and 31B are charts showing the circumferential speed of the applicator roll and the nip pressure which are controlled in association with the change of the line speed.

The result of the control of the film thickness as shown in FIG. 30(A) was obtained by holding constant the urging force $N_A$ and a circumferential speed $V_P$ of the pickup roll, changing a circumferential speed $V_A$ of the applicator roll as shown in FIG. 30(A) in association with a line speed LS shown in FIG. 30(B) and controlling a nip pressure $N_P$ in accordance with the above-described model equation (13) as shown in FIG. 31(B).

The circumferential speed $V_A$ was set at LS+40 (mpm) in the first roll coater (front surface coating), and was set at LS+30 (mpm) in the roll coater of model B (rear surface coating).

Furthermore, the above-described line speed LS and circumferential speed $V_A$ together with the known values were applied to the following equation (21) determined by deforming the equation (13), whereby a nip pressure $N_P$ was determined as a value corresponding to the changes shown above.

$$N_P = [\{1 + 1/\alpha\,(V_A/V_P)^{\beta})\} \cdot E_{PA}^{0.4} \cdot R_{AP}^{-0.6}\{2/(V_A + V_P)\}^{1.6} \times \{(M \cdot LS)/(3.1 \cdot C \cdot \gamma \cdot \mu^{0.6}) + \lambda\,(N_A/B)^{-0.2} \times E_{AS}^{-0.4} \cdot R_{AS}^{0.6}(1/2)^{0.6} \cdot (V_A - LS)^{1.6}\}]^{-5} \cdot l \quad (21)$$

The result of controlling thickness of the coated film as described above is shown in FIG. 30(A), and, as apparent from this drawing, according to the present invention, it is found that, even when the line speed LS is changed, the film thickness control on the both front and rear surfaces can be performed at very high accuracy.

Description will hereunder be given of a specific example of controlling the thickness of the coated film by applying the present invention when the rubber lined on the applicator roll is expanded and moistened and the degrees of the expansion and moistening are changed with time in conjunction with FIGS. 32–35.

In this example of the control, the control of the thickness of the coated film is performed in applying the model equation (13) to the roll coater shown in FIG. 1 (type A), as described above, while the equivalent elastic modulus $E_{PA}$ between the pickup roll 14 and the applicator roll 16 and the steel sheet S, which were included in the model equation (13) were used, the elastic modulus $E_A$ (elastic modulus of the applicator roll) successively changing due to the expansion and moistening of the rubber was measured and corrected in accordance with the above-described equations (10) and (12), so that the model equation (13) was able to be amended while the changes with time of the both equivalent elastic moduli $E_{PA}$ and $E_{AS}$ were evaluated.

The object to be coated was a steel sheet having a thickness of 0.7 mm and a width of 1220 mm, and, when a paint having the concentration of 14%, viscosity of 8 cP and specific gravity of 1.0 was continuously coated on the steel sheet for 36 hours, the following result was obtained.

Figure 32:
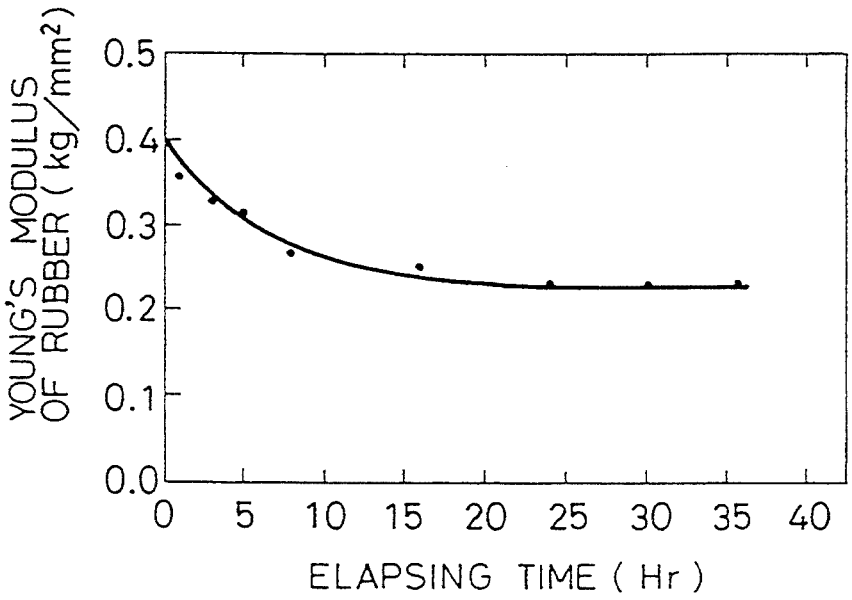
FIG. 32 is a chart showing the change of the elastic modulus of the rubber due to the expansion and moistening of the lining rubber of the applicator roll.

FIG. 32 shows the result obtained when the change with time of the Young's modulus (corresponding to the elastic modulus $E_A$) is measured.

Figure 33:
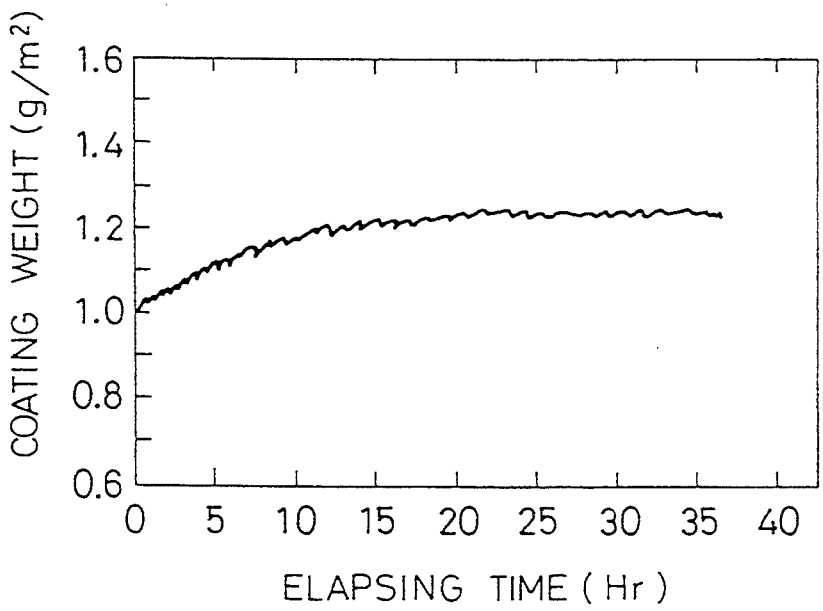
FIG. 33 is a chart showing the coating build-up caused by the expansion and moistening of the lining rubber of the applicator roll.

FIG. 33 shows the change of the coating weight when the coating is performed with the setting conditions to the roll coater having constant under the conditions where the Young's modulus of the rubber is changed. The setting conditions to the roll coater includes LS=60 mpm, $V_A$=90 mpm, $V_P$=30 mpm, $N_P$=320 kg and $N_A$=200 kg, and a target coating weight is 1.0+ or −0.2 g/m$^2$.

Figure 34:
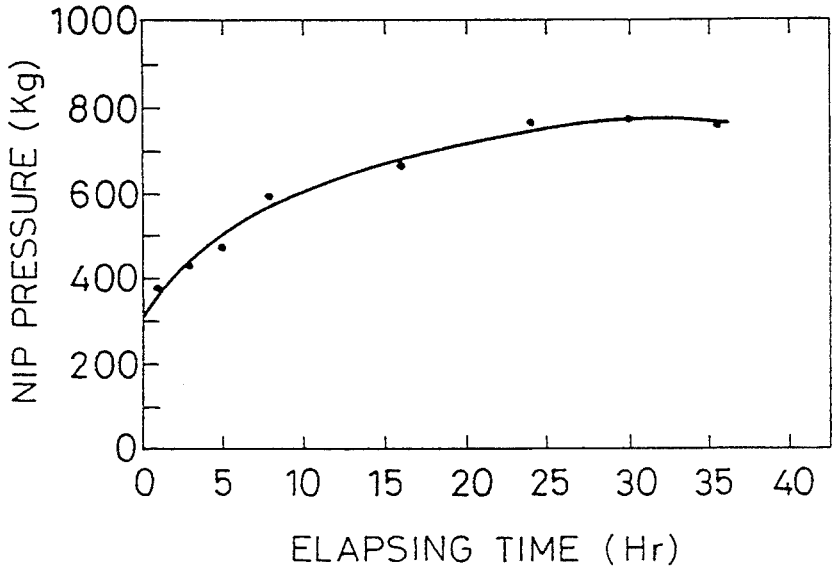
FIG. 34 is a chart showing the change of the nip pressure applied to the model equation of the present invention.
Figure 35:
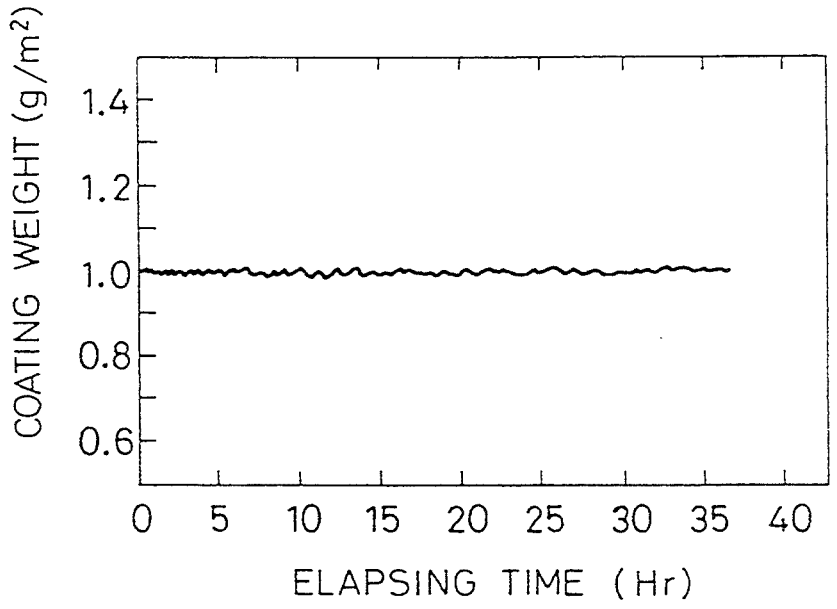
FIG. 35 is a chart showing the result of the present invention under the expansion and moistening of the lining rubber of the applicator.

FIG. 34 shows the nip pressure $N_P$ which is changed in association with the change of the Young's modulus of the rubber as shown in FIG. 30 in accordance with the above-described method when the film thickness is controlled in accordance with the model equation (13). FIG. 35 shows the result of the control in accordance with the method of the present invention, while amending the model equation (13) by use of the nip pressure $N_P$ which is caused to change with time.

As apparent from FIG. 35, according to the present invention, the thickness of the coated film can be controlled at very high accuracy even when the rubber lined on the pickup roll 16 is expanded and moistened with the continuance of the coating work.

Description will hereunder be given of the feedback control of the thickness of the coated film, wherein the coating weight measured by the first coating weight meter is applied to the above-described equation (13) for example, in the coating facility shown FIG. 2 when the lining rubber of the applicator roll 16 is expanded and moistened with time.

A measured value $M_R$ of the thickness of the coated film is obtained by the above-described coating weight meter, an elastic modulus $E_A$ of the applicator roll 16 satisfying $M=M_R$ is reversely calculated from the equation (13), and the elastic modulus $E_A$ thus determined together with other necessary values are applied to the equation (13), whereby the first roll coater 10 and the second roll coater 20 are feedback-controlled on line.

By continuously carrying out this operation, the fluctuations in the thickness of the coated film due to the expansion and moistening of the rubber of the applicator roll 16 can be corrected, so that the coating can be performed with the uniform thickness at all times. Incidentally, other factors (e.g., $V_A$, $V_P$, $N_A$, $N_P$, C, $\gamma$, $\mu$ etc.) included in the equation (13) can be also simultaneously measured and the measured values together with the above-described $M_R$ are applied to the equation (13) whereby the elastic modulus $E_A$ may be reversely calculated.

Figure 36:
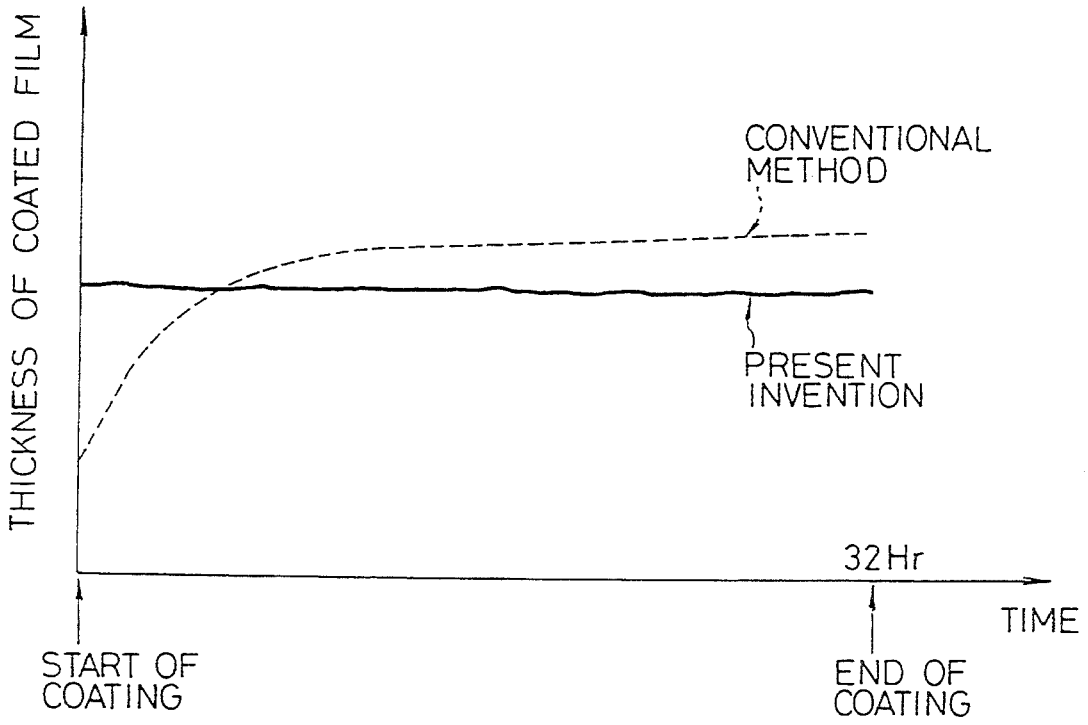
FIG. 36 is a diagram showing the result of the present invention.

FIG. 36 shows the result of the above-described feedback control performed on the galvanized steel sheet S having a thickness of 0.8 mm and a width of 1220 mm by use of the measured value $M_R$ of the thickness of the coated film under the conditions including the speed LS=100 mpm, circumferential speed $V_A$ of the applicator roll=130 mpm, circumferential speed of the pickup roll $V_P$=30 mpm, viscosity $\mu$ of the coating=30 cP and elastic modulus of the applicator roll (before the expansion and moistening)=0.32 kg/mm$^2$. Incidentally, the result shown in this drawing is obtained when the expansion and moistening work is not performed, in the cases of both the present invention and the conventional method.

Figure 37:
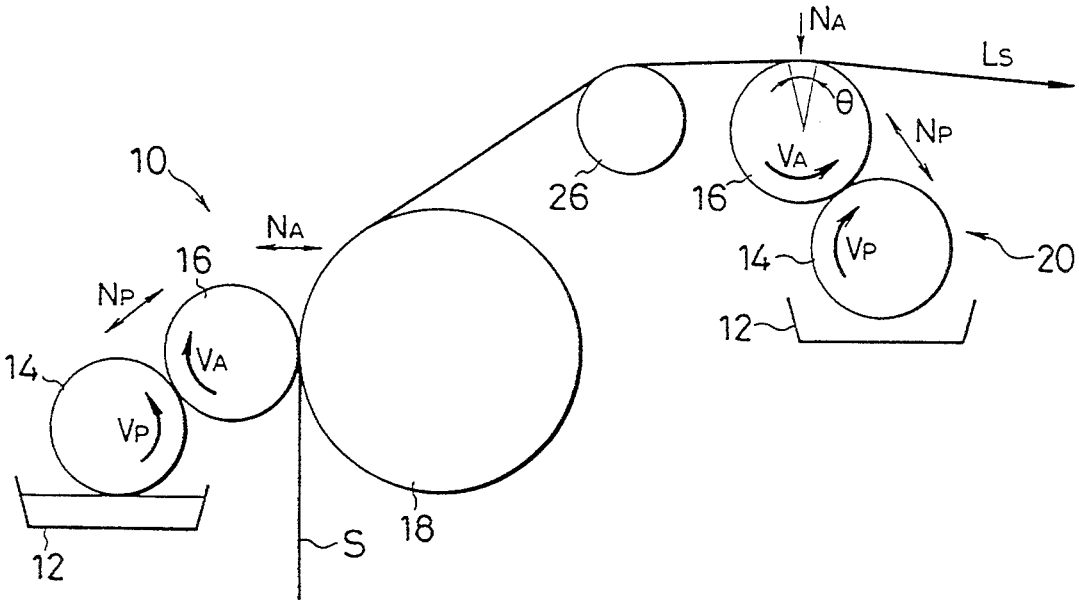
FIG. 37 is a schematic explanatory view showing the arrangement of the roll coaters applied to the fourth embodiment of the present invention.

FIG. 37 a schematic explanatory view showing the arrangement of the roll coaters applied to a fourth embodiment of the present invention.

FIG. 37 enlargedly shows the first roll coater 10 and the second roll coater 20 in FIG. 43, which are substantially identical with ones used in the second embodiment as shown in FIG. 8.

In this embodiment, as shown, during a process in which the steel sheet S, the front surface of which is coated by the first roll coater 10, is conveyed in the suspended state and coated while being supported by the second roll coater 20 from below, when the steel sheet S is coated while the joint portion between a first steel sheet and a second steel sheet, which are different in size from each other, is passed over the second roll coater, the film thickness is controlled by use of a film thickness control equation prepared by applying the elastohydrodynamic lubrication theory thereto.

In this embodiment, when the front surface of the steel sheet S is coated by the first roll coater 10, the thickness of the coated film is controlled by applying the above-described equation (8) or (13) similarly to the case of the second embodiment, however, the coating of the rear surface by the second roll coater 20 is performed as follows.

When the rear surface of the steel sheet S is coated by the second roll coater 20 also, similarly to the case of the second embodiment, the above-described film thickness control equation (8) or (13) which is applied to the first roll coater 10 can be applied. However, in applying this equation (13), the equivalent roll radius $R_{AS}$ between the applicator roll 16 and the steel sheet S is set by the above-described equation (17).

Furthermore, when the equation (13) is applied, in the coating of the front surface by the first roll coater 10, the urging force $N_A$ between the steel sheet S and the applicator roll 16 can be controlled positively, whereas, in the coating of the rear surface by the second roll coater 20 the urging force $N_A$ is determined by a tension H acting on the catenary section of the steel sheet S, so that the urging force $N_A$ should be set by the following equation (22).

$$N_A = 2H\sin(\theta/2) \quad \ldots (22)$$

where $\theta$: angle of winding

When the nip pressure $N_P$ between the pickup roll 14 and the applicator roll 16 is solved by substituting the equation (22) into the equation (13), the following equation (23) corresponding to the above-described equation (21) is obtained.

$$N_P = [\{1 + 1/(\alpha (V_A/V_P)^{\beta})\} \cdot E_{PA}^{0.4} \cdot R_{AP}^{-0.6}\{2/(V_A + V_P)\}^{1.6} \times \{(M \cdot LS)/(3.1 \cdot C \cdot \gamma \cdot \mu^{0.6}) + \lambda ((2H\sin(\theta/2))/B)^{-0.2} \times E_{AS}^{-0.4} \cdot R_{AS}^{0.6}(1/2)^{0.6}(V_A - LS)^{1.6}\}]^{-5} \cdot l \quad (23)$$

In this embodiment, the tension H is measured by a tension measuring device, not shown, and the measured tension value of the catenary section is applied to an item of the tension H in the equation (23), whereby the nip pressure $N_P$ is controlled in accordance with the tension value H which changes with time. Therefore, according to this embodiment, even when the tension acting on the catenary section changes with time as the sheet joint point having the large difference in sectional area between the steel sheets passes the catenary section, the both preceding and succeeding steel sheets can be coated with the uniform film thickness.

A fifth embodiment of the present invention will hereunder be described.

This embodiment is substantially identical with the fourth embodiment except for that the sheet joint point is tracked, the tension H for suppressing the fluctuations of the catenary shape is calculated in accordance with a method to be described hereunder, the tension H is applied to the film thickness control equation (23) and the nip pressure $N_P$ is controlled.

According to this embodiment, in a process of coating the rear surface by the second roll coater 20 while the steel sheet S suspended between an inlet roll and an outlet roll is continuously conveyed, when the connecting portion (sheet joint point) between the first steel sheet and the second steel sheet, which are different in size from each other, is passed through the catenary section, the tension H(Xs) of the steel sheet S is set in accordance with the following equation (24) including a correcting function f(Xs/L) using only an entering extent (Xs/L) from the inlet roll of the above-described connecting portion as a parameter, and the catenary shape is controlled by the tension H(Xs) to thereby coat the steel sheet S. Incidentally, here, the inlet roll is the applicator roll 16 of the second roll coater 20 as shown in FIG. 43 and the outlet roll is a fulcrum roll 28 positioned at the outlet.

$$H(Xs) = H2 - (H2 - H1)f(Xs/L) \quad \ldots (24)$$

where

H2: tension of the first steel sheet

H1: tension of the second steel sheet

Xs: entering position of the connecting portion from the inlet roll

L: total length of the catenary

A method of introducing the above-described equation (24) will hereunder be described.

Figure 38:
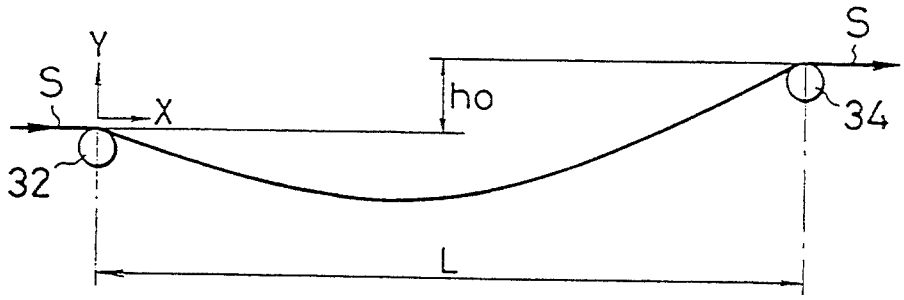
FIG. 38 is a chart showing the catenary shape at the time of the steady state.

FIG. 38 is a schematic explanatory view typically showing the steel sheet (web-like member) S suspended in the catenary shape between an inlet fulcrum roll (corresponding to the applicator roll 16 of the second roll coater 20 in FIG. 43) 32 and an outlet fulcrum roll (corresponding to a fulcrum roll 28 in FIG. 43) 34, and continuously conveyed in a direction indicated by an arrow.

A catenary equation representing a shape in a suspended state of the steel sheet S, i.e., a catenary shaped curve (hereinafter referred to a catenary curve) is given by the following equation (25) in general, in an XY coordinate system adopting the inlet fulcrum roll 32 as an origin.

$$Y=a\cosh\{(X-C1)/a\}+C2 \quad \ldots (25)$$

However, the equation (25) is a high order function and it is complicate to assemble into as a control model, and is approximated to a secondary function by using a relation in the following equation (26).

$$\begin{aligned}\cosh X &= (e^x - e^x)/2 \\ &= 1/2(1 + X + X^2/2! + X^3/3! \ldots + \\ &\quad 1 - X + X^2/2! - X^3/3! \ldots) \\ &\approx 1 + X^2/2\end{aligned} \quad (26)$$

Now, when assumption is made that the catenary equation in the case of the steel sheet S having no connecting portion is Y0, the equation may be deformed to be the following equation (27).

$$\begin{aligned}Y0 &= a\cosh\{(X - C1)/a\} + C2' \\ &\approx [1 + 1/2 \cdot \{(X - C1)/a\}^2] + C2' \\ &= 1/2a \cdot (X - C1)^2 + C2\end{aligned} \quad (27)$$

Here, a=H/W

H: tension (kg)

W: weight per unit length of the steel sheet [kg/mm]

L: total length of the catenary (span) [mm]

The border conditions in the above-described equation (27) is as follows.

$$\text{Since } Y0=0 \text{ when } X=0,\ C1^2/2a+C2=0 \quad \ldots (28)$$

$$\text{Since } Y0=h0 \text{ when } X=1,\ (L-C1)^2/2a+C2=h0 \quad \ldots (29)$$

where h0: difference in height between the fulcrums [mm]

From the equation (29)—the equation (28), C1 and C2 can be determined as follows.

$$(L-C1)^2/2a-C1^2/2a=h0\ L^2/2a-LC1/a=h0$$
$$\therefore C1=L/2-aho/L,\ C2=-C1^2/2a \quad \ldots (30)$$

From the above, the basic catenary equation in the time of the steady state where no connecting portion is present in the steel sheet may be represented by the equations (26) and (30).

Figure 39:
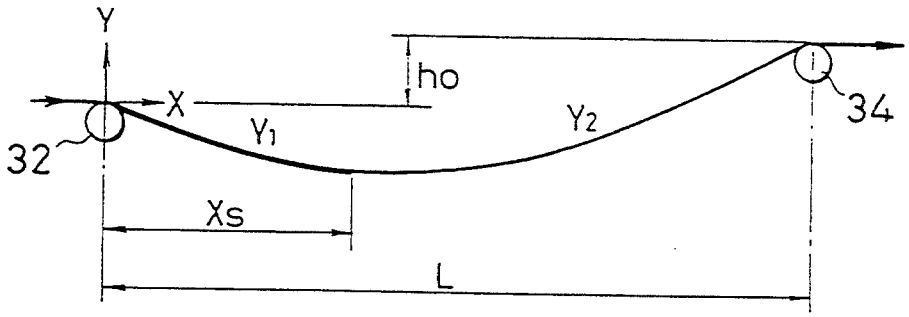
FIG. 39 is a chart showing the catenary shape at the time of the unsteady state.

On the other hand, as shown in FIG. 39 corresponding to FIG. 38, when the preceding first steel sheet indicated by a thin line is welded to the succeeding second steel sheet indicated by a thick line, by the same calculation as the aforesaid calculation, a catenary curve Y2 of the preceding steel sheet is given by an equation (32) and a catenary curve Y1 of the succeeding steel sheet is given by an equation (31), respectively. Incidentally, Xs in the drawing indicates the entering position of the welded portion (connecting portion) between the preceding steel sheet and the succeeding steel sheet.

$$\begin{aligned}Y1 &= a1 \cdot \cosh\{(X - C1)/a1\} + C2 \\ &\approx 1/2a1 \cdot (X - C1)^2 + C2\end{aligned} \quad (31)$$

$$\begin{aligned}Y2 &= a2 \cdot \cosh\{(X - C3)/a2\} + C4 \\ &\approx 1/2a2 \cdot (X - C3) + C4\end{aligned} \quad (32)$$

Here, a1: H/W1 [mm]

a2: H/W2 [mm]

W1: weight per unit length of the succeeding steel sheet [kg/mm]

W2: weight per unit length of the preceding steel sheet [kg/mm]

The border conditions are as follows.

$$\text{Since } Y1=0 \text{ when } X=0,\ C1^2/2a1+C2=0 \quad \ldots (33)$$

$$\text{Since } Y2=h0 \text{ when } X=L,\ (L-C3)^2/2a2+C4=h0 \quad \ldots (34)$$

$$\text{Since } Y1=Y2 \text{ when } X=Xs,\ (Xs-C1)/2a1+C2=(Xs-C3)^2/2a2+C4 \quad \ldots (35)$$

$$\text{Since } dY1/dX=dY2/dX \text{ when } X=Xs,\ (Xs-C1)/a1=(Xs=C3)/a2 \quad \ldots (36)$$

By solving the equation (33)–(36), the catenary equations when the welded portion (sheet joint point) passes through the catenary section are as follows.

$$\text{The succeeding steel sheet when } 0<X<Xs$$
$$Y1=1/2a1'.(X-C1)^2+C2 \quad \ldots (31)$$

$$\text{The preceding steel sheet when } Xs<X<L$$
$$Y2-1/2a2'(X-C3)^2+C4 \quad \ldots (32)$$

Here, $C1=Xs+a1(L-Xs)^2/2a2L-Xs^2/2L-a1h0/L$ $C2=-C1^2/2a1$ $C3=Xs-a2/a1'(Xs-C1)$ $C4=Xs^2/2a1-XsCl/al-a^2/2a1^2(Xs-C1)^2$ For the catenary equations given by the above-described equations(31) and (32), the amounts of fluctuations of the catenary (differences from the steady state) are evaluated by the following equations.

$$\delta(X) = \begin{cases} Y1 - T0 & (0 \leqq X \leqq Xs) \\ Y2 - Y0 & (Xs \leqq X \leqq L) \end{cases} \quad (37)$$

As the result of examination from every respects the patterns of changes of the tension in order to minimize the amount of the catenary fluctuations given by the above-described equation (37), the inventors of the present invention have found that the tension H(Xs) during the transient time from the tension H2 at the time of only the preceding first steel sheet (first web-like member) to the tension H1 at the time of only the succeeding second sheet (second web-like member) can be unambiguously given by the above-described equation (24) by applying the correcting function f(Xs/L) adopting only the entering extent (Xs/L) of the connecting portion (sheet joint point) in the catenary as the parameter, irrespective of the difference in size between the preceding and succeeding steel sheets. This equation (24) is described here again.

$$H(Xs)=H2-(H2-H1)f(Xs/L) \quad \ldots (24)$$

Here

H(Xs) : tension when the sheet joint point is at Xs

H2: tension U.T't1'B1 when only the first steel sheet is present

H1: tension U.T't2'B2 when only the second steel sheet is present

U.T: reference unit tension t2, t1: respective sheet thicknesses of the first and second steel sheets B2, B1: respective sheet widths of the first and second steel sheets Xs: position of the sheet joint point Then, by turning the above-described correcting function f(Xs/L) into the following equation (38), the amount of fluctuations δ (X) can be made very small.

$$f(Xs/L)=\alpha(Xs/L)+\beta(Xs/L)^2-\gamma(Xs-L)^3+\delta(Xs/L)^4-\epsilon(Xs/L)^5 \quad \ldots (38)$$

Here, $\alpha$ is about 0.05, $\beta$ about 4, $\gamma$ about 7, $\delta$ about 6 and $\epsilon$ about 2.5.

Figure 40:
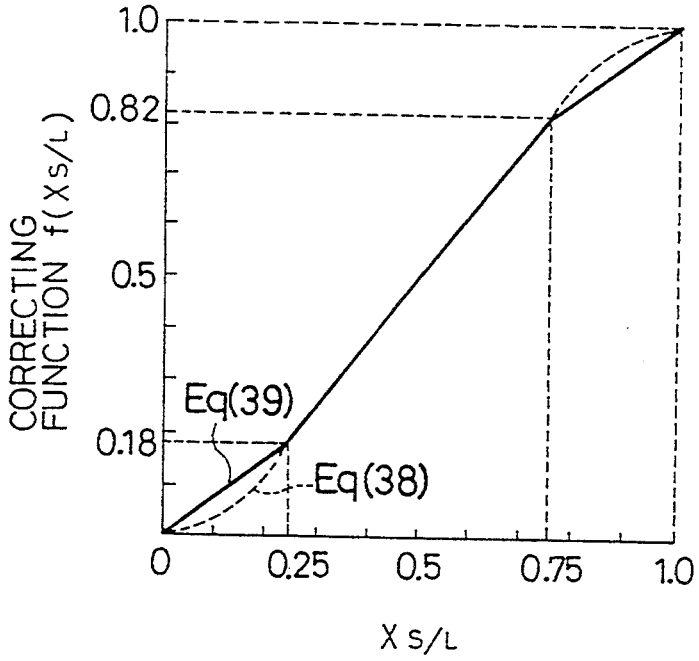
FIG. 40 is a chart showing the characterics of the correcting function used for the catenary control.

Furthermore, since the equation (38) is of a high order function, this equation (38) may be turned into the following equation (39) which is approximated by a polygonal line, whereby the tension can be controlled easily and at satisfactorily high accuracy. FIG. 40 shows the relationship between the equations (38) and (39).

$$f(Xs/L) = \begin{cases} \alpha'(Xs/L) & (0 \leqq Xs/L \leqq 0.25) \\ \beta'(Xs/L) - \gamma' & (0.25 \leqq Xs/L \leqq 0.75) \\ \delta'(Xs/L) + \epsilon' & (0.75 \leqq Xs/L \leqq 1.0) \end{cases} \quad (39)$$

Here, $\alpha'$ is about 0.7, $\beta'$ about 1.3. $\gamma'$ about 0.1. $\delta'$ about 0.7 and $\epsilon'$ about 0.3.

As described above in detail, the control is performed so as to obtain a tension calculated by applying the equation (38) or (39) to the above-described equation (24) on the basis of the tracking (pursuing) information of the connecting portion, so that the catenary shape can be held substantially constant.

Accordingly, when the coating is performed while the connecting portion between the first steel Sheet and the second steel sheet, which have the difference in the sectional area, is passed over the second roll coater 20, the nip pressure $N_P$ is determined by using the tension obtained by applying the equation (38) or (39) to the above-described equation (24), so that the nip pressure $N_P$ can be utilized for the film thickness control.

According to this embodiment described above in detail, the tension setting value when the catenary is controlled at the constant shape is taken into the control equation, whereby, even when the urging force $N_A$ is changed every moment during the passing of the sheet joint point through the catenary section, the change of the urging force $N_A$ can be corrected by the nip pressure $N_P$. As the result, the coating weight to the steel sheets can be prevented from changing, whereby the coating can be performed with the uniform film thickness, so that the product quality can be stabilized.

A specific example when the coating is performed by applying this embodiment will hereunder be described.

As a steel sheet, there was used one, in which a second steel sheet having a width of 1220 mm and a thickness of 1.0 mm is connected a preceding first steel sheet having a thickness of 0.5 mm and a width of 1220 mm. Heretofore, a connecting steel sheet having a thickness of 0.7–0.8 mm has been interposed between the first steel sheet and the second steel sheet.

The coating conditions are as follow.

paint : chromate (concentration 1.3%, viscosity 1.7 cP and specific gravity 1.06)

line speed : LS=30 mpm circumferential speed of the applicator roll : $V_A$=75 mpm circumferential speed of the pickup roll : $V_P$=40 mpm rubber hardness of the applicator roll : 52°.

As the tension H to be applied to the equation (23), there was used a calculated tension required for controlling the catenary at a constant shape according to the above-described method. Namely, the set tension H(Xs) was calculated by tracking the position Xs of the sheet joint point and applying the function f of the following equation (40) corresponding to the above-described equation (38) to the above-described equation (24).

$$f=0.05(Xs/L)+4.1(Xs/L)^2-6.9(Xs/L)^3+6.3(Xs/L)^4-2.5(Xs/L)^5 \quad \ldots (40)$$

Here, $H_2$=1678 kg, $H_1$=3355 kg, L=60 m.

Figure 41:
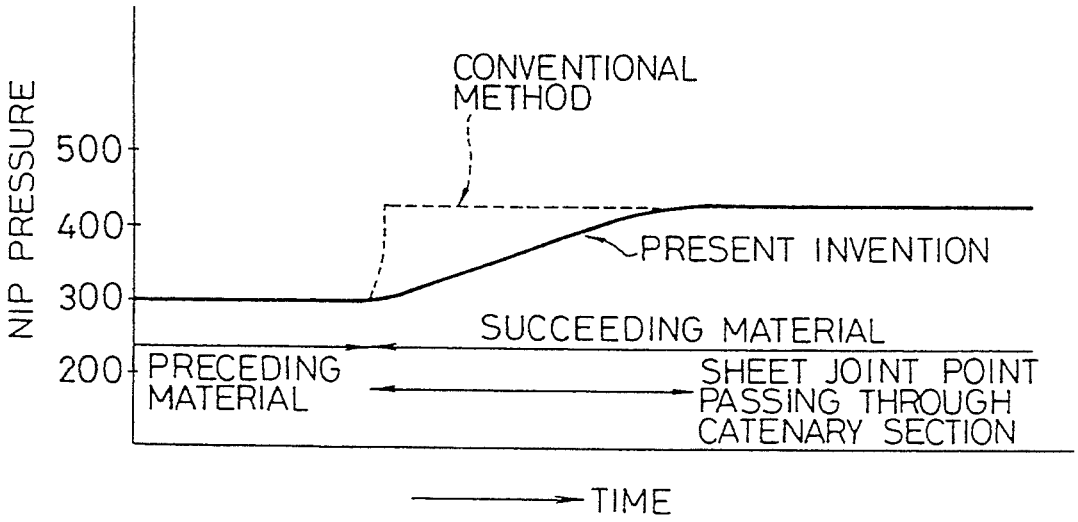
FIG. 41 is a chart showing the relationship between the nip pressure and the elapsing time when an embodiment of the present invention is applied.
Figure 42:
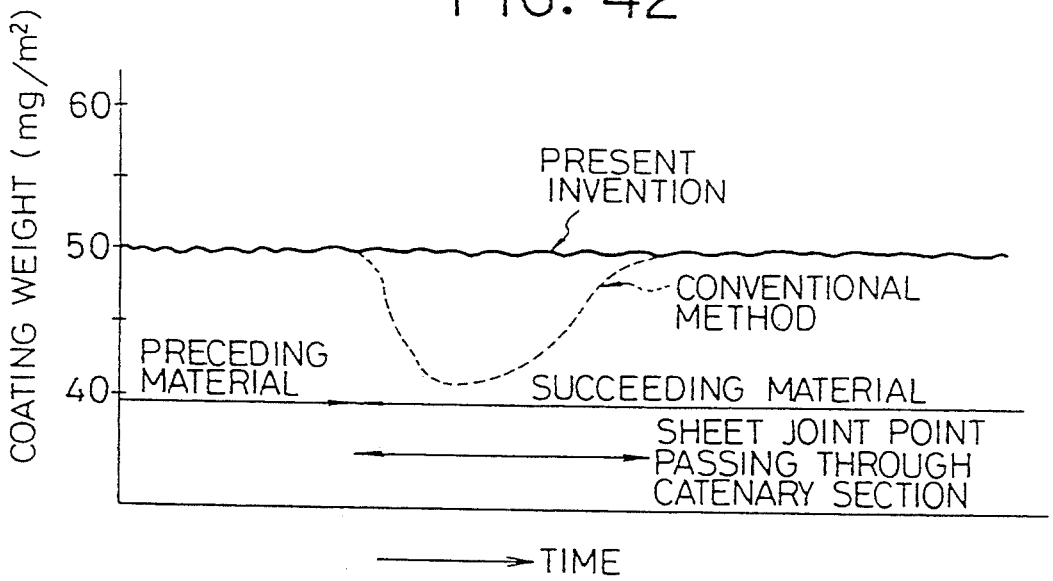
FIG. 42 is a chart showing the relationship between the coating weight and the elapsing time when the above-described embodiment is applied.

The nip pressure $N_P$ was controlled by applying the calculated tension H(Xs) to the equation (23). The result is shown in FIG. 41. Furthermore, the change in the coating weight is shown in FIG. 42. For the purpose of comparison, the result at the time of the conventional control performed at the stages is additionally illustrated in the same drawings.

As apparent from FIGS. 41 and 42, according to this embodiment, the change in the coating weight which has occurred when the sheet joint point passes through the catenary section can be prevented, and it is apparent that both the first and second steel sheets can be coated with the uniform film thickness.

The present invention has been specifically described hereinabove. However, the present invention is not limited to the above embodiments.

For example, the film thickness control equation applied to the coating of the rear surface according to the present invention is not limited to the equation (23) applied thereto with the elastohydrodynamic lubrication theory as shown in the above embodiments, and the equation may be the above-described equation (8) or any other control equations.

Furthermore, the film thickness control factor reflecting the tension H changing with time is not limited to the urging force (nip pressure) $N_P$ between the pickup roll and the applicator roll, and for example, the circumferential speed of the applicator roll, the circumferential speed of the pickup roll and the like may be used.

Furthermore, also the method of determining the tension H is not limited to the one shown in the embodiment, and, for example, the method disclosed in the above-described Japanese Patent Laid-Open No. 305750/1991 may be used.

Further, the types of the roll coaters, the number of the rolls and the rotating directions may be desirably changed. Accordingly, the front roll is not limited to the pickup roll.

What is claimed is:

1. An apparatus for controlling thickness of a coated film of paint on a continuously moving sheet member, the apparatus comprising:

a means for supplying paint;

a roll coater including an applicator roll, said applicator roll transferring and coating the paint on the sheet member;

means, in fluid communication with said paint supplying means, for measuring a viscosity of the paint;

means, in fluid communication with said paint supplying means, for measuring a concentration of the paint; and means, in fluid communication with said applicator roll, for controlling at least one of a nip pressure of said applicator roll and a circumferential speed of said applicator roll in accordance with the measured viscosity and concentration of the paint, thereby controlling the thickness of the paint.

2. An apparatus according to claim 1, wherein said viscosity measuring means comprises a viscosimeter.

3. An apparatus according to claim 2, wherein said concentration measuring means comprises a concentration meter.

* * * * *